US007485604B2

(12) United States Patent
Negoro et al.

(10) Patent No.: US 7,485,604 B2
(45) Date of Patent: Feb. 3, 2009

(54) LUBRICANT COMPOSITION AND METHOD FOR USING AND PREPARING THEREOF

(75) Inventors: Masayuki Negoro, Minami-ashigara (JP); Ken Kawata, Minami-ashigara (JP)

(73) Assignee: Fujifilm Corporation, Minato-Ku, Tokyo (JP)

( * ) Notice: Subject to any disclaimer, the term of this patent is extended or adjusted under 35 U.S.C. 154(b) by 791 days.

(21) Appl. No.: 10/854,241

(22) Filed: May 27, 2004

(65) Prior Publication Data

US 2005/0014657 A1 Jan. 20, 2005

(30) Foreign Application Priority Data

May 27, 2003 (JP) ..... 2003-148642

(51) Int. Cl.

| | |
|---|---|
| ***C07D 251/54*** | (2006.01) |
| ***C10M 133/42*** | (2006.01) |
| ***C10M 133/44*** | (2006.01) |
| ***C10M 169/04*** | (2006.01) |

(52) U.S. Cl. ..... 508/258; 508/255; 508/287; 508/266

(58) Field of Classification Search ..... 508/258, 508/255, 266, 287

See application file for complete search history.

(56) References Cited

U.S. PATENT DOCUMENTS 3,869,423 A * 3/1975 Minagawa et al. ..... 524/100

(Continued)

FOREIGN PATENT DOCUMENTS

EP 570838 A1 * 11/1993

(Continued)

*Primary Examiner*—Glenn Caldarola
*Assistant Examiner*—Jim Goloboy

(74) *Attorney, Agent, or Firm*—Buchanan Ingersoll & Rooney PC

(57) ABSTRACT

A novel lubricant composition is disclosed. The composition comprises a molecular complex formed by intermolecular interaction between molecules capable of tautomerization, wherein at least one of the molecules has at least one ester bond and is represented by the formula (I) (but excluding any compound represented by the formula (TAM) below)

formula (I)

where, $Q^{11}$ represents an oxygen atom, sulfur atom or $N(R^{13})$; $R^{11}$ to $R^{13}$ independently represents a hydrogen atom or a substituent, at least one of which being a substituent containing at least one ester bond and at least one chain selected from the group consisting of $C_4$ or longer alkyl chains and the like; and formula (TAM)

where $R^1$, $R^2$ and $R^3$ independently represents a substituent, x, y and z independently represent an integer of 1 to 5.

9 Claims, 1 Drawing Sheet

U.S. PATENT DOCUMENTS

| | | | | | |
|---|---|---|---|---|---|
| 4,889,648 | A | * | 12/1989 | Higaki et al. | 508/257 |
| 5,037,568 | A | * | 8/1991 | O'Neil et al. | 508/258 |
| 5,652,201 | A | * | 7/1997 | Papay et al. | 508/228 |

FOREIGN PATENT DOCUMENTS

| | | |
|---|---|---|
| JP | 2003-064389 | 3/2003 |
| JP | 2003-064390 | 3/2003 |

* cited by examiner

LUBRICANT COMPOSITION AND METHOD FOR USING AND PREPARING THEREOF

FIELD OF THE INVENTION

The present invention belongs to a technical field of lubricant composition to be supplied to mechanical friction sliding members and a method for preparing thereof, and more specifically belongs to a technical field of lubricant excellent in low friction properties and wear resistance under extreme pressure, and also in sustainability of such properties, and a method for preparing thereof. And the present invention also relates to a novel molecular complex useful as extreme pressure agents, friction coefficient modifiers and anti-wear additives.

RELATED ART

Performances required for lubricant relate to that it should be able to lower friction coefficient at mechanical friction sliding members over a wide temperature range and pressure range, and that such effects are sustained as long as possible. It is also expected for the lubricant to not only improve lubricating properties between mechanical friction sliding members, but also to thereby good provide wear resistance to such friction sliding members in themselves. Effects, which is brought about by lubricant such as engine oil, of reducing friction coefficient of the friction sliding members and increasing service life thereof directly result in improved fuel cost for mechanical driving, or in other words, energy saving. Elongation of the service life of engine oil not only ensures reduction in waste oil but also reduction in $CO_2$ emission, so that it will be desirable in terms of environmental compatibility which has increasingly been attracting recent public attention. As for bearings or gears, which operate under particularly severe frictional conditions among various sliding members for use in industrial machines, use of conventional lubricant such as lubricating oil or grease may result in film breakage or sticking of the lubricant under particularly severe lubricating conditions, which makes it difficult to obtain a desired low friction coefficient due to abrasion scars. This sometimes lowers the reliability of apparatus, and tends to increase severity of the friction conditions especially for the case that the apparatus is to be downsized, which has been one reason for preventing the apparatus from being downsized. So that there has been a strong demand for a lubricant which can bring about the effects even under severe conditions, can contribute to downsizing of the apparatus, and is excellent in energy saving property.

Lubricants which have previously been used are generally such that comprising a lubricant base oil as a major component, and a lubricant aids such as an organic compound blended thereto. In particular, organic molybdenum compounds recently have attracted an attention as a lubricant auxiliary. organic molybdenum compounds are excellent in various properties such as wear resistance, durability under extreme pressure (load resistance) and low friction property even during operation of sliding members of a mechanical apparatus under severe frictional conditions such as high temperature, high or low speed, high load, downsizing and weight reduction, so that the compounds have attracted a good deal of attention as a material capable of effectively exhibiting lubricating effects under a marginal lubricating condition which is higher in pressure than the fluid lubricating condition under ordinary pressure.

Although the organic molybdenum compound may exhibit an excellent lubricant effect even under a severe friction condition, it is apparently inappropriate in view of environmental compatibility since the lubricating oil contains a considerable amount of heavy metals such as molybdenum or zinc, sulfides which can readily be oxidized to thereby produce sulfur oxides adversely affecting the lubricating oil or sliding member per se, and even affecting the environment, and phosphoric acids which undesirably eutrophicates rivers and seas. Another disadvantage relates to that molybdenum oxide/sulfide film formed on the sliding surface is gradually peeled off under friction to thereby produce a new film, so that shortage in the amount of either of organic molybdenum compound or organic zinc compound, which are source materials, may sharply lose the effect. A countermeasure of increasing the amount of such organic molybdenum compound and organic zinc compound is however undesirable since it may increase the amount of byproducts generated in the system by such peeling-off of the film, which adversely affect the sliding machinery per se, so that it is less expectable in a current situation of a system using the foregoing organic molybdenum compound to improve fuel cost through elongation of the service life of the lubricant. As has been described in the above, there has been no proposal of a lubricant which is free from any of environmentally hazardous substance or environmental pollutant such as heavy metal elements, phosphate compounds and sulfides, capable of exhibiting excellent lubricating properties, and capable of retaining such properties for a long period.

Furthermore, lubricants have been recently required to have more various properties and higher performances with the developments of various high performance machines and with frequent use under severe conditions.

SUMMARY OF THE INVENTION

It is therefore an object of the present invention to provide a lubricant composition capable of exhibiting excellent properties not only in a state of mixture with conventional lubricant base oil, but also in a state not mixed with such lubricant base oil. It is another object of the present invention to provide a lubricant composition capable of retaining low friction property and anti-abrasion property on the sliding surface resistance for a long period, in particular even under extreme pressure. It is another object of the present invention to provide a lubricant composition capable of readily forming a uniform thin film, and being applicable to the surface of magnetic recording media or micro-machines, and a method for preparing thereof. It is still another object of the present invention to provide a lubricant composition excluding environmentally-less-compatible heavy metals, phosphate group and sulfides to thereby concomitantly achieve both of longer service life and environmental compatibility.

And it is another object of the present invention to provide molecular complexes which are useful as extreme pressure agents, friction coefficient modifiers and anti-wear additives.

The present inventors conducted various studies in order to solve the aforementioned problems of the prior arts, and as a result, they found that molecular complexes, formed of at least one compound having a functional group capable of tautomerization and a particular segment, have excellent lubricant properties. On the basis of this finding, the present invention was achieved. Further, they also found that molecular complexes having a planar structure are especially excellent in lubricant properties.

In one aspect, the present invention provides a lubricant composition comprising a molecular complex formed by intermolecular interaction between molecules capable of tautomerization, wherein at least one of the molecules has at least one ester bond and is represented by the formula (I) (but excluding any compound represented by the formula (TAM) below):

formula (I)

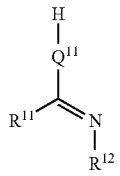

where, $Q^{11}$ represents an oxygen atom, sulfur atom or $N(R^{13})$; $R^{11}$ to $R^{13}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{11}$ and $R^{12}$, or $R^{11}$ and $R^{13}$ may bind with each other to thereby form a cyclic structure; and forumula (TAM)

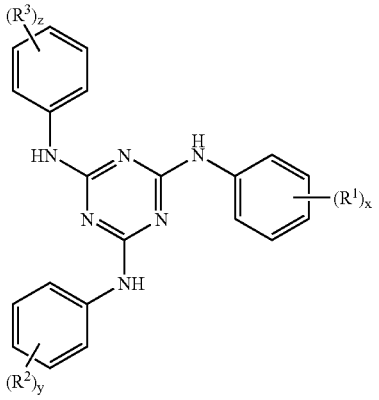

where $R^1$, $R^2$ and $R^3$ independently represents a substituent; x, y and z independently represent an integer of 1 to 5.

The molecules may respectively have a functional group capable of tautomerization and interact with each other via the functional group in a geometrically complementary positional relation such that the molecular complex has a planar structure.

At least one of the molecules having at least one ester bond is desirably selected from the group represented by the formula (II) (but excluding any compound represented by the foregoing formula (TAM)):

formula (II)

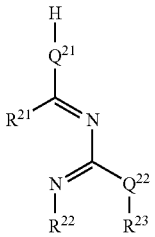

where, $Q^{21}$ and $Q^{22}$ independently represents an oxygen atom, sulfur atom or $N(R^{24})$; $R^{21}$ to $R^{24}$ independently represents a hydrogen atom or a substituent, at least one of which being a substituent containing at least one ester bond and at least one chain selected from the groups consisting of $C_4$ or longer alkyl chains, oligoalkyleneoxy chains, $C_2$ or longer perfluoroalkyl chains, perfluoroalkyl ether chains and organic polysilyl chains; $R^{21}$ and $R^{22}$, $R^{22}$ and $R^{23}$, or $R^{21}$ and $R^{24}$ may bind with each other to thereby form a cyclic structure.

At least one of the molecules having at least one ester bond is desirably selected from the group represented by any one of the formulae (III) to (XI) (but excluding any compound represented by the foregoing formula (TAM))):

forumula (III)

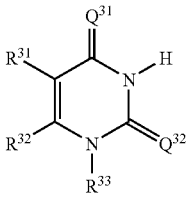

where, $R^{31}$ to $R^{33}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{31}$ and $Q^{32}$ independently represent an oxygen atom or a sulfur atom; $R^{31}$ and $R^{32}$, or $R^{32}$ and $R^{33}$ may bind with each other to thereby form a cyclic structure;

formula (IV)

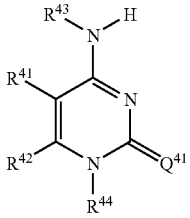

where, $R^{41}$ to $R^{44}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{41}$ and represents an oxygen atom or a sulfur atom; $R^{41}$ and $R^{42}$, $R^{41}$ and $R^{43}$, or $R^{42}$ and $R^{44}$ may bind with each other to thereby form a cyclic structure;

formula (V)

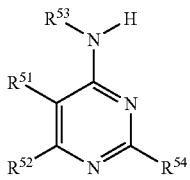

where, $R^{51}$ to $R^{54}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{51}$ and $R^{52}$, or $R^{51}$ and $R^{53}$ may bind with each other to thereby form a cyclic structure;

formula (VI)

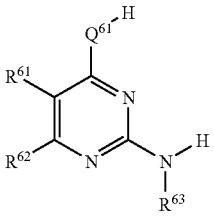

where, $R^{61}$ to $R^{63}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{61}$ represents an oxygen atom or sulfur atom; $R^{61}$ and $R^{62}$ may bind with each other to thereby form a cyclic structure;

formula (VII)

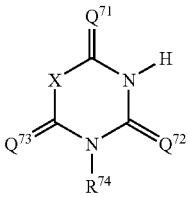

where, $Q^{71}$ to $Q^{73}$ independently represents an oxygen atom or a sulfur atom; X represents —C(=$R^{71}$)— or —C($R^{72}$)($R^{73}$)—; $R^{71}$ represents a substituent; $R^{72}$ to $R^{74}$ independently represents a hydrogen atom or a substituent; at least one of $R^{71}$ to $R^{74}$ represents a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{72}$ and $R^{73}$ may bind with each other to thereby form a cyclic structure;

formula (VIII)

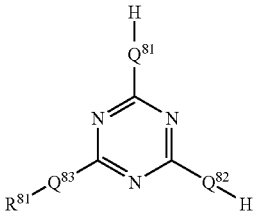

where, $Q^{81}$ to $Q^{83}$ independently represents an oxygen atom, a sulfur atom or N($R^{82}$); $R^{81}$ and $R^{82}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{81}$ and $R^{82}$ may bind with each other to thereby form a cyclic structure when $Q^{83}$ represents N($R^{82}$);

formula (IX)

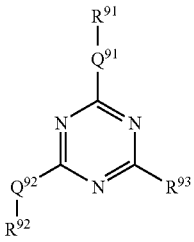

where, $Q^{91}$ and $Q^{92}$ independently represents a single bond, N($R^{94}$) where $R^{94}$ represents a hydrogen or $C_{1-30}$ alkyl group, oxygen atom, sulfur atom, carbonyl, sulfonyl, or any combination thereof; $R^{91}$ and $R^{92}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{93}$ represents a halogen atom, hydroxyl, amino, mercapto, cyano, alkylthio, arylthio, carboxyl or a salt thereof, sulfo or a salt thereof, hydroxyamino, ureido, or urethane;

formula (X)

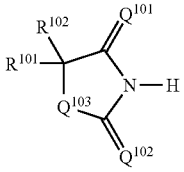

where, $Q^{101}$ to $Q^{103}$ independently represents an oxygen atom, sulfur atom or N($R^{103}$); $R^{101}$ to $R^{103}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; and formula (XI)

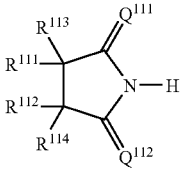

where, $Q^{111}$ and $Q^{112}$ independently represents an oxygen atom, sulfur atom or N($R^{115}$); $R^{111}$ to $R^{115}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{111}$ and $R^{113}$, $R^{113}$ and $R^{114}$, $R^{113}$ and $R^{111}$, $R^{112}$ and $R^{114}$, or $R^{114}$ and $R^{115}$ may bind with each other to thereby form a cyclic structure.

As embodiments of the present invention, the lubricant composition wherein the molecular complex comprises "n" (n is an integer of 1 or above) kinds of molecules capable of tautomerization $A_1$ to $A_n$ represented by the formula (I) (but excluding any compound represented by the foregoing formula (TAM)); the lubricant composition wherein the molecular complex comprises at least one molecule capable of tautomerization represented by the foregoing formula (I) (but excluding any compound represented by the foregoing formula (TAM)), and further comprises at least one molecule capable of tautomerization represented by the formula (XII):

formula (XII)

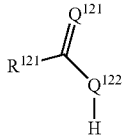

where, $R^{121}$ represents a substituent; $Q^{121}$ and $Q^{122}$ independently represents an oxygen atom or a sulfur atom; the lubricant composition wherein the molecule represented by the formula (I) shows pKa of 2 to 12; the lubricant composition of claim 1, wherein the molecular complex shows a thermal phase transfer temperature pattern, which is measured by the differential scanning calorimetry (DSC), differing from those shown by the component compounds thereof; and the lubricant composition further comprising lubricant base oil in an amount of 50 wt % or more are provided.

In another aspect, the present invention provides a method for preparing lubricant composition comprising a step of adding "n" (n is an integer of 1 or above) kinds of compounds, having at least one functional group capable of tautomerization, represented by the foregoing formula (I) (but excluding any compound represented by the foregoing formula (TAM)) so as to form a molecular complex formed of "n" kinds of compounds capable of tautomerization; and the method comprising said step of adding further one or more compounds represented by the formula (XII) so as to form said molecular complex composed of both of the "n" kinds of compounds and the one or more compounds represented by the formula (XII).

The present invention relates to use of a molecular complex formed by intermolecular interaction between molecules capable of tautomerization, wherein at least one of the molecules is represented by the formula (I) (but excluding any compound represented by the formula (TAM) below) for reducing friction coefficient between sliding surfaces.

DETAILED DESCRIPTION OF THE INVENTION

Figure 1:
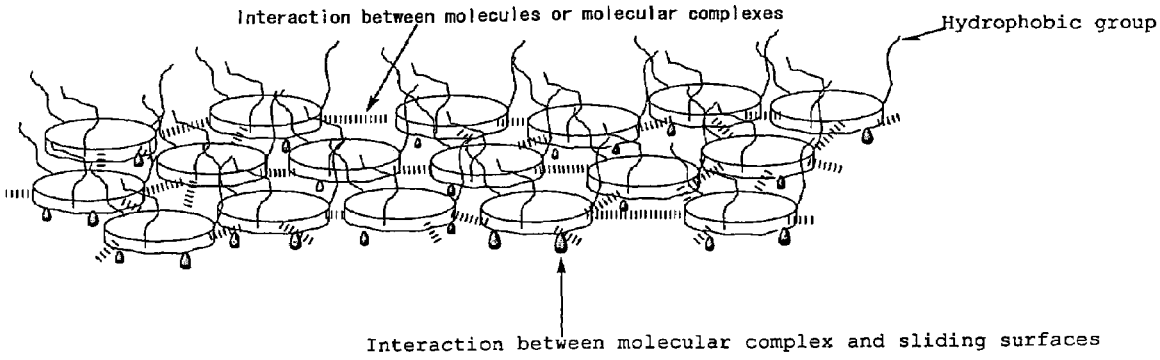
FIG. 1 is a schematic drawing for explaining orientation status of the lubricant composition of the present invention.

The present invention will be detailed below. It should now be noted that, in this specification, any notation for expressing numerical range using a word "to" indicates a range defined by values placed before and after "to", both ends inclusive as minimum and maximum values.

The present invention relates to a lubricant composition comprising a molecular complex formed by intermolecular interaction between molecules capable of tautomerization. In the present invention, same kind of molecules may form the molecular complex, or two or more kinds of molecules may form the molecular complex. One of the molecules, which is a component of the molecular complex, has at least one ester bond segment. The ester bond-containing molecule may have a core segment and at least one side chain bonding to the core segment, and the ester bond may be included in the side chain. The ester bond segment in the molecule may be represented by the formula (a) or (b).

Formula (a)

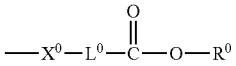

Formula (b)

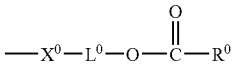

In the formulae, $X^0$ represents a single bond or a bivalent linking group selected from the group consisting of $NR^1$, where $R^1$ is a hydrogen atom or $C_{1-30}$ alkyl group, oxygen, sulfur, carbonyl, sulfonyl or any combinations thereof.

In the formulae, $L^0$ represents a bivalent linking group selected from the group consisting of an alkylene group, $NR^1$, where $R^1$ is a hydrogen atom or $C_{1-30}$ alkyl group, oxygen, sulfur, carbonyl, sulfonyl or any combinations thereof. The bivalent linking group may be substituted or non-substituted. The term of "alkylene group" is used for not only any chain alkylene groups but also any cycloalkylene groups. $L^0$ is desirably selected from alkylene groups.

$R^0$, which is located at the end of the side chain, represents a substituted or non-substituted alkyl group or aryl group.

It is noted that the left end, namely —$X^0$, bonds to the core segment.

Among these, the formula (a) is preferred. Especially, When $R^0$ is selected from alkyl groups substituted with an ethylene oxy group, or in other words, when the ester bond segment is represented by the formula (c), both of low friction coefficient and low viscosity can be obtained.

Formula (c)

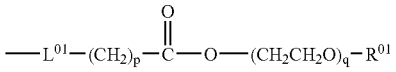

In the formula, $L^{01}$ is defined as same as $L^0$. $R^{01}$ represents a substituted or non-substituted $C_{1-30}$ alkyl group. P and q respectively represent an integer. The p is desirably from 1 to 20 and more desirably from 2 to 10. The q is desirably from 1 to 10, and more desirably from 1 to 5.

The lubricant composition of the present invention comprises at least one molecular complex. The molecular complex is formed by intermolecular interaction between molecules capable of tautomerization. At least one of the molecules is selected from the group represented by the formula (I) provided that none of the molecules is selected from the group represented by the formula (TAM).

formula (I)

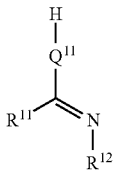

In the formula, $Q^{11}$ represents an oxygen atom, sulfur atom or $N(R^{13})$; $R^{11}$ to $R^{13}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{11}$ and $R^{12}$, or $R^{11}$ and $R^{13}$ may bind with each other to thereby form a cyclic structure.

formula (TAM)

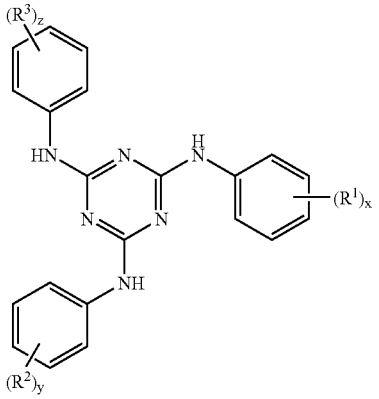

In the formula, $R^1$, $R^2$ and $R^3$ independently represents a substituent; x, y and z independently represent an integer of 1 to 5.

In the foregoing formulae (I) and (TAM), the substituents represented by $R^{11}$ to $R^{13}$, and $R^1$ to $R^3$, respectively, are exemplified by halogen atom, alkyl group (including cycloalkyl group and bicycloalkyl group), alkenyl group (including cycloalkenyl group and bicycloalkenyl group), alkynyl group, aryl group, heterocyclic group, cyano, hydroxyl, nitro, carboxyl, alkoxy group, aryloxy group, silyloxy group, heterocyclic oxy group, acyloxy group, carbamoyloxy group, alkoxycarbonyloxy group, aryloxycarbonyloxy group, amino group (including anilino group), acylamino group, aminocarbonylamino group, alkoxycarbonylamino group, aryloxycarbonylamino group, sulfamoylamino group, alkyl- and arylsulfonylamino group, mercapto group, alkylthio group, arylthio group, heterocyclic thio group, sulfamoyl group, sulfo group, alkyl- and arylsulfinyl group, alkyl- and arylsulfonyl group, acyl group, aryloxycarbonyl group, alkoxycarbonyl group, carbamoyl group, aryl- and heterocyclic azo group, imide group, phosphino group, phosphinyl group, phosphinyloxy group, phosphinylamino group, and silyl group. The substituents $R^{11}$ to $R^{13}$ also include above substituents further substituted with at least one of such substituents.

More specifically, examples of such substituents include halogen atom (e.g., chlorine atom, bromine atom, iodine); alkyl groups [straight-chain, branched or cyclic, substituted or non-substituted alkyl group, which are typified by alkyl groups (preferably $C_{1-30}$ alkyl groups such as methyl, ethyl, n-propyl, isopropyl, t-butyl, n-octyl, eicosyl, 2-chloroethyl, 2-cyanoethyl, 2-ethylhexyl); cycloalkyl groups, (preferably, $C_{3-30}$ substituted or non-substituted cycloalkyl groups such as cyclohexyl, cyclopentyl and 4-n-dodecylcyclohexyl); bicycloalkyl groups (preferably, $C_{5-30}$ substituted or non-substituted bicycloalkyl group, or in other words, a monovalent group obtained by removing one hydrogen atom from $C_{5-30}$ bicycloalkane, such as bicyclo[1,2,2]heptane-2-yl and bicyclo[2,2,2]octane-3-yl); and multicyclo structure having more than two rings, where also alkyl groups contained in the substituents described below (e.g., alkyl group in alkylthio group) express alkyl groups based on the same concept]; alkenyl groups [straight-chain, branched or cyclic, substituted or non-substituted alkenyl groups, which are typified by alkenyl groups (preferably $C_{2-30}$ substituted or non-substituted alkenyl groups such as vinyl, allyl, prenyl, geranyl and oleyl); cycloalkenyl groups (preferably, $C_{3-30}$ substituted or non-substituted cycloalkenyl group, or in other words, a monovalent group obtained by removing one hydrogen atom from $C_{3-30}$ cycloalkene, such as 2-cyclopentene-1-yl and 2-cyclohexene-1-yl); bicycloalkenyl groups (substituted or non-substituted bicycloalkenyl group, preferably $C_{5-30}$ substituted or non-substituted bicycloalkenyl group, or in other words, a monovalent group obtained by removing one hydrogen group from bicycloalkene having one double bond, such as bicyclo[2,2,1]hepto-2-ene-1-yl and bicyclo[2,2,2]octo-2-ene-4-yl); alkynyl groups (preferably $C_{2-30}$ substituted or non-substituted alkynyl groups such as ethynyl, propargyl and trimethylsilylethynyl); aryl groups (preferably $C_{6-30}$ substituted or non-substituted aryl groups such as phenyl, p-tolyl, naphthyl, m-chlorophenyl and o-hexadecanoylaminophenyl); heterocyclic groups (preferably a 5- or 6-membered monovalent group obtained by removing one hydrogen atom from substituted or non-substituted aromatic or non-aromatic heterocyclic compound, and more preferably 5- or 6-membered $C_{3-30}$ aromatic heterocyclic groups, such as 2-furyl, 2-thienyl, 2-pyrimidinyl and 2-benzothiazolyl); cyano; hydroxyl; nitro; carboxyl; alkoxy groups (preferably $C_{1-30}$ substituted or non-substituted alkoxy group such as methoxy, ethoxy, isopropoxy, t-butoxy, n-octyloxy and 2-methoxyethoxy); aryloxy groups (preferably $C_{6-30}$ substituted or non-substituted aryloxy group, such as phenoxy, 2-methylphenoxy, 4-t-butylphenoxy, 3-nitrophenoxy and 2-tetradecanoylaminophenoxy); silyloxy groups (preferably $C_{3-20}$ silyloxy group such as trimethylsilyloxy and t-butyldimethylsilyloxy); heterocyclic oxy groups (preferably $C_{2-30}$ substituted or non-substituted heterocyclic oxy groups such as 1-phenyltetrazol-5-oxy and 2-tetrahydropyranyloxy); acyloxy groups (preferably formyloxy group, $C_{2-30}$ substituted or non-substituted alkylcarbonyloxy groups, $C_{6-30}$ substituted or non-substituted arylcarbonyloxy groups, such as formyloxy, acetyloxy, pivaloyloxy, stearoyloxy, benzoyloxy and p-methoxyphenylcarbonyloxy); carbamoyloxy groups (preferably, $C_{1-30}$ substituted or non-substituted carbamoyloxy groups, such as N,N-dimethylcarbamoyloxy, N,N-diethylcarbamoyloxy, morpholinocarbonyloxy, N,N-di-n-octylaminocarbonyloxy and N-n-octylcarbamoyloxy); alkoxycarbonyloxy groups (preferably $C_{2-30}$ substituted or non-substituted alkoxycarbonyloxy groups, such as methoxycarbonyloxy, ethoxycarbonyloxy, t-butoxycarbonyloxy and n-octylcarbonyloxy); aryloxycarbonyloxy groups (preferably $C_{7-30}$ substituted or non-substituted aryloxycarbonyloxy groups, such as phenoxycarbonyloxy, p-methoxyphenoxycarbonyloxy and p-n-hexadecyloxyphenoxycarbonyloxy); amino groups (preferably amino, $C_{1-30}$ substituted or non-substituted alkylamino groups and $C_{6-30}$ substituted or non-substituted anilino groups, such as amino, methylamino, dimethylamino, anilino, N-methylanilino and diphenylamino); acylamino groups (preferably formyl amino group, $C_{1-30}$ substituted or non-substituted alkylcarbonylamino groups and $C_{6-30}$ substituted or non-substituted arylcarbonylamino groups, such as formylamino, acetylamino, pivaloylamino, lauroylamino, benzoylamino and 3,4,5-tri-n-octyloxyphenylcarbonylamino); aminocarbonylamino groups (preferably $C_{1-30}$ substituted or non-substituted aminocarbonylamino groups, such as carbamoylamino, N,N-dimethylaminocarbonylamino, N,N-diethylaminocarbonylamino and morpholinocarbonylamino); alkoxycarbonylamino groups (preferably $C_{2-30}$ substituted or non-substituted alkoxycarbonylamino groups, such as methoxycarbonylamino, ethoxycarbonylamino, t-butoxycarbonylamino, n-octadecyloxycarbonylamino and N-methylmethoxycarbonylamino); aryloxycarbonylamino groups (preferably, $C_{7-30}$ substituted or non-substituted aryloxycarbonylamino groups, such as phenoxycarbonylamino, p-chlorophenoxycarbonylamino and m-n-octyloxyphenoxycarbonylamino); sulfamoylamino groups (preferably $C_{0-30}$ substituted or non-substituted sulfamoylamino groups, such as sulfamoylamino, N,N-dimethylaminosulfonylamino and N-n-octylaminosulfonylamino); alkyl- and arylsulfonylamino groups (preferably $C_{1-30}$ substituted or non-substituted alkylsulfonylamino groups and $C_{6-30}$ substituted or non-substituted arylsulfonylamino groups, such as methylsulfonylamino, butylsulfonylamino, phenylsulfonylamino, 2,3,5-trichlorophenylsulfonylamino and p-methylphenylsulfonylamino); mercapto; alkylthio groups (preferably $C_{1-30}$ substituted or non-substituted alkylthio groups, such as methylthio, ethylthio and n-hexadecylthio); arylthio groups (preferably $C_{6-30}$ substituted or non-substituted arylthio groups, such as phenylthio, p-chlorophenylthio and m-methoxyphenylthio); heterocyclic thio groups (preferably $C_{2-30}$ substituted or non-substituted heterocyclic thio groups, such as 2-benzothiazolylthio and 1-phenyltetrazol-5-yl-thio); sulfamoyl groups (preferably $C_{0-30}$ substituted or non-substituted sulfamoyl groups, such as N-ethylsulfamoyl, N-(3-dodecyloxypropyl)sulfamoyl, N,N-dimethylsulfamoyl, N-acetylsulfamoyl, N-benzoylsulfamoyl and N-(N'-phenylcarbamoyl) sulfamoyl); sulfo; alkyl- and arylsulfinyl groups (preferably $C_{1-30}$ substituted or non-substituted alkylsulfinyl groups and $C_{6-30}$ substituted or non-substituted arylsulfinyl groups, such as methylsulfinyl, ethylsulfinyl, phenylsulfinyl and p-methylphenylsulfinyl); alkyl- and arylsulfonyl groups (preferably $C_{1-30}$ substituted or non-substituted alkylsulfonyl groups and $C_{6-30}$ substituted or non-substituted arylsulfonyl groups, such as methylsulfonyl, ethylsulfonyl, phenylsulfonyl and p-methylphenylsulfonyl); acyl groups (preferably formyl group, $C_{2-30}$ substituted or non-substituted alkylcarbonyl groups and $C_{7-30}$ substituted or non-substituted arylcarbonyl groups, such as acetyl, pivaloyl, 2-chloroacetyl, stearoyl, benzoyl, p-n-octyloxyphenylcarbonyl); aryloxycarbonyl groups (preferably $C_{7-30}$ substituted or non-substituted aryloxycarbonyl groups, such as phenoxycarbonyl, o-chlorophenoxycarbonyl, m-nitrophenoxycarbonyl and p-t-butylphenoxycarbonyl); alkoxycarbonyl groups (preferably $C_{2-30}$ substituted or non-substituted alkoxycarbonyl group, such as methoxycarbonyl, ethoxycarbonyl, t-butoxycarbonyl and n-octadecyloxycarbonyl); carbamoyl groups (preferably $C_{1-30}$ substituted or non-substituted carbamoyl groups, such as carbamoyl, N-methylcarbamoyl, N,N-dimethylcarbamoyl, N,N-di-n-octylcarbamoyl and N-(methylsulfonyl)carbamoyl); aryl- and heterocyclic azo groups (preferably $C_{6-30}$ substituted or non-substituted arylazo groups and $C_{3-30}$ substituted or non-substituted heterocyclic azo groups, such as phenylazo, p-chlorophenylazo and 5-ethylthio-1, 3, 4-thiadiazol-2-yl-azo); imide groups (preferably N-succinimide and N-phthalimide); phosphino groups (preferably $C_{2-30}$ substituted or non-substituted phosphino groups, such as dimethylphosphino, diphenylphosphino and methylphenoxyphosphino); phosphinyl groups (preferably $C_{2-30}$ substituted or non-substituted phosphinyl groups, such as phosphinyl, dioctyloxyphosphinyl and diethoxyphosphinyl); phosphinyloxy groups (preferably $C_{2-30}$ substituted or non-substituted phosphinyloxy groups, such as diphenoxyphosphinyloxy and dioctyloxyphosphinyloxy); phosphinylamino groups (preferably $C_{2-30}$ substituted or non-substituted phosphinylamino groups, such as dimethoxyphosphinylamino and dimethylaminophosphinylamino); silyl groups (preferably $C_{3-30}$ substituted or non-substituted silyl groups, such as trimethylsilyl, t-butyldimethylsilyl and phenyldimethylsilyl).

Of these substituents, those having a hydrogen atom may have an additional substituent which substitutes such hydrogen atom. Examples of such additional substituent include alkylcarbonylaminosulfonyl group, arylcarbonylaminosulfonyl group, alkylsulfonylaminocarbonyl group and arylsulfonylaminocarbonyl group, which are more specifically methylsulfonylaminocarbonyl, p-methylphenylsulfonylaminocarbonyl, acetylaminosulfonyl and benzoylaminosulfonyl groups.

It is to be noted that at least one of the substituents $R^{11}$ to $R^{13}$ is a substituent containing at least one ester bond segment and at least one chain selected from the group consisting of $C_4$ or longer alkyl chains, oligoalkyleneoxy chains, $C_2$ or longer perfluoroalkyl chains, perfluoroalkylether chains and organic polysilyl chains. The substituents $R^{11}$ to $R^{13}$ themselves may be a $C_4$ or longer alkyl chain or the like, or it is also allowable that the substituents described in the above are further substituted with such $C_4$ or longer alkyl chain or the like.

When any substituent of $R^{11}$ to $R^{13}$ is the group represented by the formula (a) or (b), either $-L^0-$ or $—R^0$ contains a chain selected from the group consisting of $C_4$ or longer alkyl chains, oligoalkyleneoxy chains, $C_2$ or longer perfluoroalkyl chains, perfluoroalkylether chains and organic polysilyl chains. Both of $-L^0-$ and $—R^0$ may contain a chain selected from the group. These chains are preferably contained in $R^0$.

Such $C_4$ or longer alkyl chains may be straight or branched. Preferable examples of the substituents containing the $C_4$ or longer straight alkyl chain include n-octyl, n-octyloxy, n-octylthio, n-octylamino, n-nonyl, n-nonyloxy, n-decyl, n-decyloxy, n-undecyl, n-undecyloxy, n-dodecyl, n-dodecyloxy, n-dodecylthio, n-dodecylamino, n-pentadecyl, n-pentadecyloxy, n-hexadecyl, n-hexadecyloxy, n-hexadecylthio and n-hexadecylamino. Preferable examples of the substituents containing the $C_4$ or longer branched alkyl chain include 2-ethylhexyl, 2-ethylhexyloxy, 2-ethylhexylthio, 2-ethylhexylamino, 2-hexyldecyl, 2-hexyldecylthio, 2-hexyldecylamino, 3,7,11,15-tetramethylhexadecyl, 3,7,11,15-tetramethylhexadecyloxy, 3,7,11,15-tetramethylhexadecylthio and 3,7,11,15-tetramethylhexadecylamino.

The alkylene portion of the oligoalkyleneoxy chain may be a straight chain or branched chain. Examples of the substituent containing the oligoalkyleneoxy chain include diethyleneoxy group, triethyleneoxy group, tetraethyleneoxy group, dipropyleneoxy group and hexyloxyethyleneoxyethyleneoxy group.

The alkyl portion of the $C_2$ or longer perfluoroalkyl chain may be a straight chain or branched chain. Preferable examples of the substituent containing the perfluoroalkyl chain include pentadecylfluoroheptyl group, pentadecylfluoroheptylcarbonyloxy group, heptadecylfluorooctyl group and pentadecylfluorooctylsulfonyl group.

The alkyl portion of the perfluoroalkylether chain may be a straight chain or branched chain. Examples of the substituent containing such perfluoroalkylether chain include isopropyleneoxide, methylene oxide, ethylene oxide and its mixed chains, and substituents obtained by substituting the alkyl portion of the propylene oxide with fluorine atoms.

The organic polysilyl chain is such that having a silicon-atom-containing group as a side chain of a long-chained substituent (e.g., poly(p-trimethylsilylstyrene) and poly(1-trimethylsilyl-1-propine)), or such that having silicon atoms within a main chain of a long-chain substituent, where the latter is more preferable. Such preferable long-chain substituent having silicon atoms within the main chain thereof can be exemplified by those having a repetitive unit represented by the formula (s) below and having any of straight-chain, branched-chain, cyclic or polycyclic structure.

formula (s)

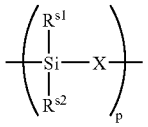

In the formula, $R^{s1}$ and $R^{s2}$ independently represent a substituent. $R^{s1}$ and $R^{s2}$ may bind with each other to thereby form a cyclic structure. More specifically, $R^{s1}$ and $R^{s2}$ can be typified by the substituents represented by $R^{11}$ to $R^{13}$ in the foregoing formula (I). Among those, alkyl group is preferred. X represents an atomic group which comprises an oxygen atom, nitrogen atom, alkylene group, phenylene group, silicon atom, metal atom or any combinations thereof. X is preferably an oxygen atom or an atomic group composed of an oxygen atom and alkylene group, and more preferably, an oxygen atom. A notation "p" is an integer of 1 to 200, and preferably 3 to 30. Specific examples of the organic polysilyl chain include polysiloxane, polysilazane, polysilmethylene, polysilphenylene, polysilane, and polymetallosiloxane.

In the formula (I), $R^{11}$ and $R^{12}$ or $R^{11}$ and $R^{13}$ may bind with each other to thereby form a cyclic structure. The cyclic structures possibly formed by linking of $R^{11}$ and $R^{12}$ include heterocycles such as pyridine ring, pyrimidine ring, pyrazine ring, pyrazole ring, oxazole ring and thiazole ring; benzo condensed rings thereof; and heterocyclic aromatic condensed rings such as purine ring, naphthylizine ring and pteridine ring. The cyclic structures possibly formed by liking of $R^{11}$ and $R^{13}$ include pyrrolidine ring, thiazoline ring and piperidine ring.

The scope of the formula (I) includes the scope of the formula (II) (but excluding any compound represented by the foregoing formula (TAM)).

formula (II)

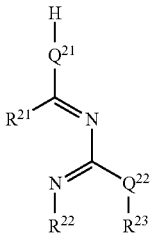

In the formula (II), $Q^{21}$ and $Q^{22}$ independently represents an oxygen atom, sulfur atom or $N(R^{24})$; $R^{21}$ to $R^{24}$ independently represents a hydrogen atom or substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{21}$ and $R^{22}$, $R^{22}$ and $R^{23}$, or $R^{21}$ and $R^{24}$ may bind with each other to thereby form a cyclic structure.

Examples of substituents respectively represented by $R^{21}$ to $R^{24}$ are same as those of substituents respectively represented by $R^{11}$ to $R^{13}$ in the foregoing formula (I), and also the preferable examples thereof are same as those for $R^{11}$ to $R^{13}$. Examples of the substituent containing a $C_4$ or longer alkyl chain, oligoalkyleneoxy chain, $C_2$ or longer perfluoroalkyl chain, perfluoroalkylether chain or organic polysilyl chain are same as those for $R^{11}$ to $R^{13}$ in the formula (I).

Examples of cyclic structures possibly formed by linking of $R^{21}$ and $R^{22}$ include heterocycles such as imidazole ring, triazole ring, oxadiazole ring, pyrimidine ring and triazine ring; benzo condensed ring (e.g., quinazoline ring) thereof; and heterocyclic aromatic condensed ring such as purine ring, naphthylizine ring and pteridine ring. The cyclic structures possibly formed by liking of $R^{22}$ and $R^{23}$, or $R^{21}$ and $R^{24}$ include pyrrolidine ring, thiazoline ring and piperidine ring, pyrazole ring, oxazole ring and thiazole ring.

The molecule represented by the formula (I) (but excluding any molecule represented by the foregoing formula (TAM)) preferably has a cyclic segment. When the molecule has a cyclic segment, the molecular complex can form a planar structure and effectively cover the sliding surface. Among cyclic segments, cyclic segments containing a nitrogen atom are preferred. Preferable examples of the compounds having such cyclic structure include compounds capable of tautomerization represented by the formulae (III) to (XI) (but excluding any compound represented by the foregoing formula (TAM)). In particular those represented by any of the formulae (III) to (IX) included within the scope of the formula (II) are preferable.

forumula (III)

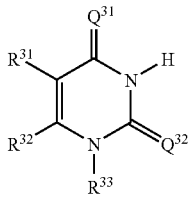

In the formula, $R^{31}$ to $R^{33}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; and $Q^{31}$ and $Q^{32}$ independently represent an oxygen atom or a sulfur atom. $R^{31}$ and $R^{32}$, or $R^{32}$ and $R^{33}$ may bind with each other to thereby form a cyclic structure. The $R^{31}$ to $R^{33}$ may contain the group represented by the formula (a) or (b), may be the group represented by the formula (a) or (b) itself.

formula (IV)

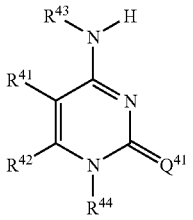

In the formula, $R^{41}$ to $R^{44}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; and $Q^{41}$ and represents an oxygen atom or a sulfur atom. $R^{41}$ and $R^{42}$, $R^{41}$ and $R^{43}$, or $R^{42}$ and $R^{44}$ may bind with each other to thereby form a cyclic structure. The $R^{41}$ to $R^{44}$ may contain the group represented by the formula (a) or (b), may be the group represented by the formula (a) or (b) itself.

formula (V)

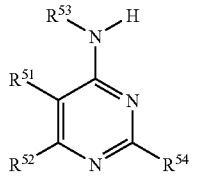

In the formula, $R^{51}$ to $R^{54}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains. $R^{51}$ and $R^{52}$, or $R^{51}$ and $R^{53}$ may bind with each other to thereby form a cyclic structure. The $R^{51}$ to $R^{54}$ may contain the group represented by the formula (a) or (b), may be the group represented by the formula (a) or (b) itself.

formula (VI)

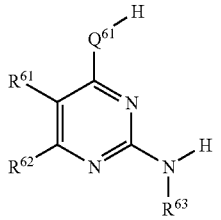

In the formula, $R^{61}$ to $R^{63}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; and $Q^{61}$ represents an oxygen atom or sulfur atom. $R^{61}$ and $R^{62}$ may bind with each other to thereby form a cyclic structure. The $R^{61}$ to $R^{63}$ may contain the group represented by the formula (a) or (b), may be the group represented by the formula (a) or (b) itself.

formula (VII)

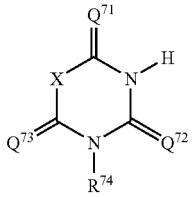

In the formula, $Q^{71}$ to $Q^{73}$ independently represents an oxygen atom or a sulfur atom; X represents —C(=$R^{71}$)— or —C($R^{72}$)($R^{73}$)—; $R^{71}$ represents a substituent; and $R^{72}$ to $R^{74}$ independently represents a hydrogen atom or a substituent, at least one of which represents a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains. $R^{72}$ and $R^{73}$ may bind with each other to thereby form a cyclic structure. The $R^{71}$ to $R^{73}$ may contain the group represented by the formula (a) or (b), may be the group represented by the formula (a) or (b) itself.

formula (VIII)

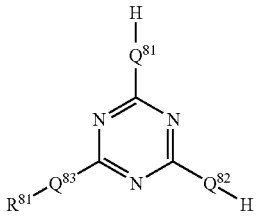

In the formula, $Q^{81}$ to $Q^{83}$ independently represents an oxygen atom, a sulfur atom or N($R^{82}$); $R^{81}$ and $R^{82}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{81}$ and $R^{82}$ may bind with each other to thereby form a cyclic structure when $Q^{83}$ represents N($R^{82}$). The $R^{81}$ to $R^{83}$ may contain the group represented by the formula (a) or (b), may be the group represented by the formula (a) or (b) itself.

formula (IX)

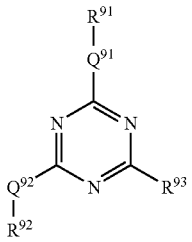

In the formula, $Q^{91}$ and $Q^{92}$ independently represents a single bond, N($R^{94}$) where $R^{94}$ represents a hydrogen or $C_{1-30}$ alkyl group, oxygen atom, sulfur atom, carbonyl, sulfonyl, or any combination thereof; $R^{91}$ and $R^{92}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; and $R^{93}$ represents a halogen atom, hydroxyl, amino, mercapto, cyano, alkylthio, arylthio, carboxyl or a salt thereof, sulfo or a salt thereof, hydroxyamino, ureido or urethane. The $R^{91}$ or $R^{92}$ may contain the group represented by the formula (a) or (b), may be the group represented by the formula (a) or (b) itself.

formula (X)

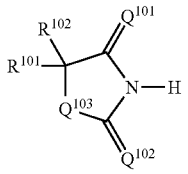

In the formula, $Q^{101}$ to $Q^{103}$ independently represents an oxygen atom, sulfur atom or $N(R^{103})$; and $R^{101}$ to $R^{103}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains. The $R^{101}$ to $R^{103}$ may contain the group represented by the formula (a) or (b), may be the group represented by the formula (a) or (b) itself.

formula (XI)

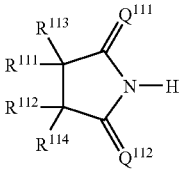

In the formula, $Q^{111}$ and $Q^{112}$ independently represents an oxygen atom, sulfur atom or $N(R^{115})$; and $R^{111}$ to $R^{115}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains. $R^{111}$ and $R^{113}$, $R^{113}$ and $R^{114}$, $R^{113}$ and $R^{115}$, $R^{112}$ and $R^{114}$, or $R^{114}$ and $R^{115}$ may bind with each other to thereby form a cyclic structure as spiro ring. The $R^{111}$ to $R^{115}$ may contain the group represented by the formula (a) or (b), may be the group represented by the formula (a) or (b) itself.

In the foregoing formulae (III) to (XI), examples of the substituents represented by $R^{31}$ to $R^{33}$, $R^{41}$ to $R^{44}$, $R^{51}$ to $R^{54}$, $R^{61}$ to $R^{68}$, $R^{71}$ to $R^{74}$, $R^{81}$, $R^{82}$, $R^{91}$ to $R^{92}$ and $R^{101}$ to $R^{103}$ and $R^{111}$ to $R^{115}$ are same as those for $R^{11}$ to $R^{13}$ in the formula (I), and also the specific and preferable examples thereof may be the same.

In the formula (VII), $=R^{71}$ is typified as those capable of forming carbon-carbon double bond such as methylene group ($=CH_2$), isopropylidene group ($=CMe_2$), nonylidene group ($=CH(n)C_8H_{17}$) and benzylidene group ($=CHC_6H_5$); those capable of forming carbon-nitrogen double bond such as imino group($=NH$), phenylimino group ($=NC_6H_5$) and octylimino group ($=N\text{-}(n)C_8H_{17}$); those capable of forming carbon-oxygen double bond such as oxo group ($=O$); and those capable of forming carbon-sulfur double bond such as thioxo group ($=S$).

The compounds represented by the formulae (III) to (VIII), (X) and (XI) have a substituent containing a $C_4$ or longer alkyl chain or oligoalkyleneoxy chain, a $C_2$ or longer perfluoroalkyl chain, perfluoroalkyl ether chain or organic polysilyl chain. These chains may be the same with specific examples explained in relation to the formula (I), and also the preferable examples thereof may be the same.

The compounds represented by the formulae (III) to (XI) have a substituent containing a $C_4$ or longer alkyl chain or oligoalkyleneoxy chain, a $C_2$ or longer perfluoroalkyl chain, perfluoroalkyl ether chain or organic polysilyl chain. Examples of these chains are same as those for the formula (I), and also the preferable examples thereof may be the same.

In the forgoing formulae, $R^{31}$ and $R^{32}$, $R^{32}$ and $R^{33}$, $R^{41}$ and $R^{42}$, $R^{41}$ and $R^{43}$, $R^{42}$ and $R^{44}$, $R^{51}$ and $R^{52}$, $R^{51}$ and $R^{53}$, $R^{61}$ and $R^{62}$ $R^{72}$ and $R^{73}$, $R^{81}$ and $R^{82}$, $R^{91}$ and $R^{92}$, $R^{111}$ and $R^{113}$, $R^{113}$ and $R^{114}$, $R^{113}$ and $R^{115}$, $R^{112}$ and $R^{114}$, and $R^{114}$ and $R^{115}$ may bind with each other to form a cyclic structure. Examples of the cyclic structures possibly formed by these groups include the rings which respectively composes aryl group and aromatic heterocyclic group exemplified as the groups having cyclic structure represented by $R^{121}$ in the formula (XII) described later.

The compound capable of tautomerization represented by the formula (I) preferably shows pKa of 2 to 12.

The molecular complex is desirably capable of forming a planar structure. Such planar molecular complexes may be formed of molecules having any combination of functional groups, one of which can interact with other functional group in a geometrically complementary positional relation. "A combination of functional groups, one of which can interact with other functional group in a geometrically complementary positional relation" herein generally means any combination which satisfies the following conditions (1) to (5). It is to be defined now that two molecules, which are the constituents of the molecular complex and are capable of interacting with each other, are a substrate σ and a receptor ρ. A higher level of molecular recognition by the receptor molecule ρ depends on a large difference between free energy of bond with the partner substrate σ and free energy of bond with other substrates which is ascribable to a relatively small interaction, where such difference is preferably large deviation from the statistical distribution range. To ensure such large difference in free energy of bond, it is necessary to satisfy the conditions (1) to (5) below:

(1) σ and ρ must have steric complementarity both in the shape and size thereof, or in other words, σ and ρ must have a convexity and a concavity respectively in their proper sites, where the convexity and concavity means complementary binding sites (e.g., hydrogen bond donor (convexity) and hydrogen bond acceptor (concavity)) as described next in (2);

(2) σ and ρ must have interactional complementarity, or in other words, σ and ρ must have, on their complementary sites capable of binding with each other, complementary binding sites (e.g., electrostatic factors such as +/−, electric charge/dipole, dipole/dipole, hydrogen bond donor/hydrogen bond acceptor), which is preferably arranged orderly, so as to successfully achieve a complementary electron-atomic core (electrostatic force, hydrogen bond, van der Waals force) distribution map;

(3) ρ and σ must have a large contact area between them, which is attainable if a plurality of interactive sites described below are available;

(4) ρ and σ must have multiple interaction sites which are necessary since interaction based on non-covalent bond is weaker than that based on covalent bond. For an exemplary case of interaction based on hydrogen bond, it is preferable that the both individually have hydrogen bond donor/hydrogen bond acceptor; and (5) ρ and σ must show a strong overall binding. Theoretically, a high stability does not always ensures high selectivity, but most cases apply. In fact, difference in free energy of bond tends to increase as the bond becomes stronger. In other words, a high bond efficiency (bound σ presents in a larger amount than free σ) requires a strong interaction. So that a strong bond between ρ and σ is indispensable in order to achieve an efficient recognition, that is, to achieve both of high stability and high selectivity.

The "planar complex" herein is defined as a molecular complex having a configuration, while absorbing on or contacting to the friction sliding surface, which allows the molecular complex to cover it in a minimum number of molecules per unit area depending on the morphology of the molecules composing the molecular complex. So that for the case the molecules composing the complex has a rod-like shape, the "planar complex" has a configuration in which the axis of inertia of the skeletal portion composing such molecule is aligned almost in the same plane with the friction sliding surface, or in other words, in parallel to the friction sliding surface in a dense manner. On the other hand, for the case the skeletal portion composing the molecules which forms the complex has a plate-like shape, the "planar complex" has a configuration in which the molecular plane of such molecule is aligned almost in the same plane with the friction sliding surface, or in other words, in parallel to the friction sliding surface in a dense manner. It is, however, to be noted that a hydrophobic group in the compound represented by the formula (I), which is typified by an alkyl group, alkoxy group, perfluoroalkyl group or polysilyl group, is not assumed as the skeletal portion. A reason why the expression of "capable of forming a planar complex" was used is that the molecular complex is only expected to form the planar complex when supplied onto the sliding surface, and that it is also allowable that such molecular complex does not have a planar structure before supplied onto the sliding surface. The lubricant composition of the present invention can exhibit an excellent lubricating effect when the planar complex efficiently covers the friction sliding surface. Even without being mixed with a base oil, the lubricant composition of the present invention can exhibit a distinctively excellent lubricating effect and an improving effect of wear-resistant property of the sliding surface, and can retain such effects for a long period. Such effects are demonstrated even under extreme pressure.

In the present invention, the functional group capable of tautomerization in the formula (I) forms one functional group composing the "combination of functional groups such that expressing the intermolecular interaction in a geometrically complementary positional relation". Examples of another functional group capable of composing the "combination of functional groups such that expressing the intermolecular interaction in a geometrically complementary positional relation" together with the functional group capable of tautomerization in the formula (I) include functional groups such as carboxilic acid group, thiocarboxilic acid group, carboamide group, thiocarbodiamide group, carboxylic acid imide group, thiocarboxilic acid imide group and ureide group.

Combination of the compound represented by the formula (I) with (thio)carboxylic acid group, (thio)carboamide group, (thio)carboxylic acid imide group or ureide group is such that strongly suggesting a possibility of stabilization by complementary intermolecular interaction in a conjugated structure based on an electron flow which can be explained by the classic electron theory of organic chemistry as shown in the formulae (XIII) to (XVI) below. It is to be noted that the formulae (XIII) and (XIV) below show a case in which $Q^{11}$ in the formula (I) represents $N(R^{13})$, while omitting illustration of $R^{11}$, $R^{12}$ and $R^{13}$. In the formulae (XV) and (XVI) below show a case in which the formula (II) expresses a 2,4-bisamino-substituted pyrimidine derivative, while omitting illustration of the substituent.

formula (XIII)

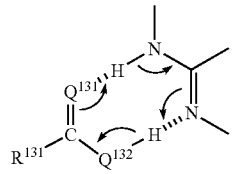

formula (XIV)

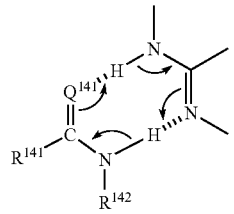

formula (XV)

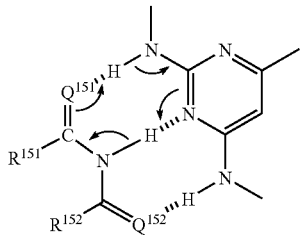

and/or

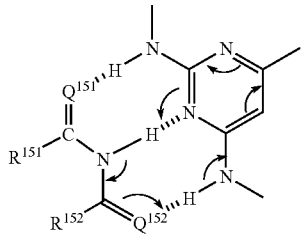

formula (XVI)

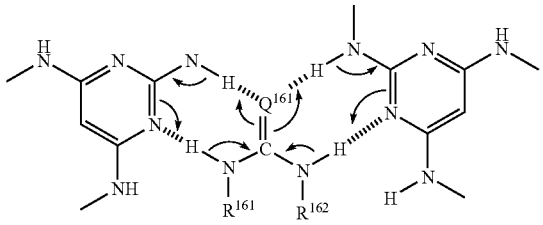

In the formulae (XIII) to (XVI), $Q^{131}$, $Q^{132}$, $Q^{141}$, $Q^{151}$, $Q^{152}$ and $Q^{161}$ independently express an oxygen atom or a sulfur atom; and $R^{131}$, $R^{141}$, $R^{142}$, $R^{151}$, $R^{152}$, $R^{161}$ and $R^{162}$ independently express a substituent; where $R^{141}$ and $R^{142}$, $R^{151}$ and $R^{152}$, $R^{161}$ and $R^{162}$ may bind with each other to thereby form a ring. The substituents respectively represented by $R^{131}$, $R^{141}$, $R^{142}$, $R^{151}$, $R^{152}$, $R^{161}$ and $R^{162}$ may be the same with those respective represented by $R^{11}$ to $R^{13}$ in the formula (I), and also the specific and preferable examples thereof may the same. $R^{141}$ and $R^{142}$, $R^{151}$ and $R^{152}$, $R^{161}$ and $R^{162}$ preferably bind with each other to thereby form a ring. Particularly in the formula (XVI), $R^{161}$ and $R^{162}$ preferably bind with each other to thereby form a ring. Examples of such ring include benzoimidazolinone, indazolinone, uracil, thiouracil, benzooxazolinone, succinimide, phthalimide, violuric acid, barbituric acid, pyrazolone, hydantoin, rhodanine, orotic acid, benzothiazolinone, ammelin, coumarine, maleic hydrazide, isatin, 3-indazolinone, parabanic acid, phthalazinone, urazole, alloxan, Meldrum's acid, uramil, caprolactone, caprolactam, thiapendione, tetrahydro-2-pyrimidinone, 2,5-piperazine dione, 2,4-quinazoline dione, 2,4-pteridine diol, folic acid, acetylene urea, guanine, adenine, cytosine, thymine and 2,4-dioxohexahydro-1,3,5-triazine.

The foregoing formulae (XIII) to (XVI) showed specific examples which satisfy the complementary conditions (1) to (5) for formation of the complex. Now the steric complementarity described in the condition (1) will be explained referring to the formula (XV). Both of 2,4-diaminotriazine structure (defined as σ) and acid imide (defined as ρ) have convexity and concavity. In σ, the amino groups form the convexitys and a nitrogen atom in the triazine ring forms the concavity. On the other hand in ρ, the carbonyl groups form the concavities and the central amino group forms the convexity. That is, σ has a structure in which convexity, concavity and convexity are aligned in this order, and ρ has a structure in which concavity, convexity and concavity are aligned in this order. This allows σ and ρ to readily form hydrogen bonds at three sites at a similar distance, which successfully achieves a strong inter-molecular bonding.

While the interactional complementarity for the condition (2) was described based on a concerted electron flow referring to the formulae (XIII) to (XVI), it can also be discussed based on electrostatic electron donation and acceptance if the start point of the arrow (→) in the formula (XIII) is expressed as $\delta^-$, and the goal of the arrow (→) is expressed as $\delta^+$, as shown in the formula (XVIII) below.

formula (XVIII)

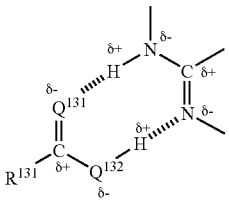

Now a series of electron flow illustrated in the formulae (XIII) to (XVI) will be explained again. The electron flows more advantageously in a two-dimensional (planar) manner than in three-dimensional manner from a viewpoint of energetics. From this point of view, R and R' in the formulae (XIV) to (XVI) preferably bind with each other to form a ring, and further preferably conjugate, and form an aromatic ring. Also R in the formula (XIII) is preferably a group having a cyclic structure, and more preferably such that having an aromatic ring group (including both of aryl group and aromatic heterocyclic group).

As for the formula (XV), 2,4-diaminotriazine structure (A) and acid imide structure (B) form hydrogen bonds at three sites, where the amino group in the structure (A) serves as the convexity, and the nitrogen atom in the triazine ring serves as the concavity.

One preferable embodiment of the molecular complex is exemplified by a molecular complex which comprises "n" (n is integer of 1 or above) kinds of compounds capable of tautomerization $A_1$ to $A_n$ represented by the formula (I) (but excluding any compound represented by the formula (TAM)). Another preferable embodiment of the molecular complex relates to such that being based on a combination of a compound capable of tautomerization represented by the formula (I) with (thio)carboxilic acid or other compound capable of tautomerization, where a combination of a compound capable of tautomerization represented by the formula (I) and a (thio)carboxylic acid represented by the formula (XII) below is particularly preferable. The (thio)carboxylic acid represented by the formula (XII) below is a compound capable of forming, together with the compound represented by the formula (I), the molecular complex based on the interaction which satisfies the foregoing conditions (1) to (5).

formula (XII)

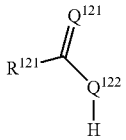

In the formula (XII), $R^{121}$ represents a substituent; and $Q^{121}$ and $Q^{122}$ independently represents an oxygen atom or a sulfur atom. The substituent represented by $R^{121}$ may be the same as those represented by $R^{11}$ to $R^{13}$ in the formula (I), and also the specific and preferable examples thereof may be the same. The compound represented by the formula (XII) preferably has in the molecular thereof a substituent containing a $C_4$ or longer alkyl chain or oligoalkyleneoxy chain, a $C_2$ or longer perfluoroalkyl chain, perfluoroalkyl ether chain or organic polysilyl chain. Specific examples of such chain may be the same as that contained in the compound represented by the formula (I), and also the preferable range thereof may be the same.

In the formula (XII), the substituent represented by $R^{121}$ is preferably such that having a cyclic structure. The substituent having a cyclic structure preferably has an aryl group or aromatic heterocyclic group. The aryl group is preferably a phenyl, indenyl, α-naphthyl, β-naphthyl, fluorenyl, phenanthrenyl, anthracenyl and pyrenyl. Among these, phenyl and naphthyl are preferable. These aryl groups are preferably substituted with a substituent containing a $C_4$ or longer alkyl chain, oligoalkyleneoxy chain, $C_2$ or longer perfluoroalkyl chain, perfluoroalkylether chain, or organic polysilyl chain, and are further preferably substituted with two or more substituents containing above chains. Specific examples of these substituents containing such chains may be the same with those described in the above. In particular, the aryl group is preferably substituted with a substituent containing a $C_8$ or longer straight-chain or branched alkyl chain such as alkyl group (octyl, decyl, hexadecyl, 2-ethylhexyl, etc.), alkoxy group (dodecyloxy, hexadecyloxy, etc.), alkylthio or arylthio group (hexadecylthio, etc.), substituted amino group (heptadecylamino, etc.), octylcarbamoyl group, octanoyl group or decylsulfamoyl group. The aryl is further preferably substituted with two or more substituents containing a $C_8$ or longer straight-chain or branched alkyl chain. The aryl can be substituted with, halogen atom, hydroxyl, cyano, nitro, carboxyl, sulfo and so forth besides the foregoing substituents.

The aromatic heterocyclic group is preferably a five- to seven-membered heterocyclic group, more preferably a five- or six-membered group, and most preferably a six-membered group. Specific examples of such skeletons can be found in heterocycles listed in "Iwanami Rikagaku Jiten (Iwanami's Physicochemical Dictionary; Iwanami Shoten, Publishers), the 3rd edition, supplement Chapter 11 "Nomenclature for Organic Chemistry", Table 4 "Names of Principal Hetero Monocyclic Compounds" on page 1606, and Table 5 "Names of Principal Condensed Heterocyclic Compounds" on page 1607. The foregoing aromatic heterocyclic groups are, similarly to the foregoing aryl group, preferably substituted with a substituent containing a $C_4$ or longer alkyl chain or oligoalkyleneoxy chain, a $C_2$ or longer perfluoroalkyl chain, perfluoroalkyl ether chain or organic polysilyl chain, where substitution by two or more chains is more preferable. Specific examples of the substituent containing such chain are same as those described in the above. The aromatic heterocyclic group may also be substituted by halogen atom, hydroxyl, cyano, nitro, carboxyl, sulfo or the like, besides the foregoing substituents.

A compound capable of forming a molecular complex with the compound represented by the formula (I) may be a low-molecular-weight compound or high-molecular-weight compound. The molecular complex may also be composed of a compound represented by the formula (I) and two or more other compounds.

Among the compounds represented by the formula (I), the compounds represented by any one of the formulae (III) to (XI) are preferred because they can form a wider planar structure in combination with same kind of molecules or another kind of molecules. Furthermore among the compounds, the barbituric acid derivatives represented by the formula (VII) are preferred because they can form a good molecular complex. The isocyanuric acid derivatives represented by the formula (VIII) have two or three sites in the molecule structure at which a planar molecular complex can be formed, and therefore they are expected to form a supramolecular planar complex. Being used in combination with a compound represented by the formula (XII), the compounds represented by the formula (VII) or (VIII) are also preferred. However even when a compound falls without the scope of any one of the formulae (III) to (XI) but within the scope of the formula (II), as long as the compound has a planar framework and a site capable of tautomerization being located near each other, the compound is also expected to form a good planar complex with another cyclic planar compound represented by any one of the formula (III) to (XI). Accordingly the most preferred compounds to be used in the present invention can not be described with a specific formula, and the desirability of a compound may depend on the adequacy of the molecular structure which the compound has for satisfying the above mentioned conditions (1) to (5).

Requirements for forming the complex described above clearly show preference of molecules capable of forming planar bond or molecules having a planar substituent, or in other words, a cyclic substituent. Such features are advantageous not only in that forming the complex, but also in that promoting interaction on the friction sliding surface, that is, effectively covering such friction sliding surface. The friction sliding surface is generally composed of an inorganic material, and more specifically, metal, metal oxide thin film formed by oxidation thereof, or ceramic, on which polar electrostatic interaction is predominant, which is stronger than van der Waals force known as a general interaction between organic substances. Now organic compounds capable of exhibiting a strong interaction with such surface will be discussed in view of the foregoing conditions (1) to (5) (assuming the sliding surface as $\sigma$, and an organic compound covering thereof as $\rho$). In view of the condition (1), a planar structure is advantageous. In view of the condition (2), the molecules must have sites responsible for electrostatic interaction stronger than van der Waals force, in such context polar bond such as hydrogen bond is suitable for a polar sliding surface. In view of the condition (3), a planar structure is advantageous. In view of the condition (4), the complex containing arylmelamine will give a great advantage since the complementary atomic group of arylmelamine is equivalent as viewed from three directions, and thus possibly forms a complex not only by two molecules but also by three or more molecules. So that it is apparent that the complex composition of the present invention is suitable for establishing a strong interaction with the sliding surface also in view of the condition (5). It is supposed that such factors make it possible to attain an extremely high wear-resistance even through the coverage is achieved only by such molecular complex composition.

The molecular complex having a non-polar or hydrophobic group will be more advantageous in that preventing the sliding surfaces of the both from contacting with each other, and in that relieving stress. The non-polar or hydrophobic group can be exemplified by long-chain alkyl group, perfluoroalkyl group, oligoalkoxy group, perfluoroalkylether group and organic polysiloxane group. These hydrophobic groups having a non-polar property will orientate so as to be repulsed from the polar sliding surface to thereby achieve energy stabilization. Introducing such hydrophobic group into an appropriate site of the compound represented by the formula (I) which composes the molecular complex (or other compound composing some others) typically allows provision of a lubricant capable of being oriented on the sliding surface as shown in FIG. 1. On the sliding surface, the lubricant capable of being oriented as shown in FIG. 1 is supposed to exhibit an extremely small friction coefficient.

Substances which can exhibit strong intermolecular interaction generally suffer from poor handling property due to their high crystallinity, high melting point, poor solubility and poor dispersion property. Introducing now a hydrophobic group can improve the solubility and dispersion property of the molecular complex into a lubricant base oil, and can also improve the handling property through reducing its crystallinity. Such introduction will be most advantageous even for the case the molecular complex is used without being mixed with any lubricant base oil, since the molecular complex will have an excellent film forming property on the sliding surface, and particularly since it can maintain a low viscosity under low temperatures.

Whether the compound represented by the formula (I) forms the molecular complex or not can be determined typically by analyzing the crystal, if it is available, so as to confirm presence of such complex. Even for the case the crystal is not available, formation of the complex is presumed if the inter-molecular force (free energy of bond), including salvation, ascribable to formation of the complex between the compound $\rho$ represented by the formula (I) and the compound $\sigma$ having a functional group which is capable of interacting with $\rho$ is almost equivalent to or smaller than free energy of bond ascribable to independent solvation of $\rho$ and $\sigma$. The formation of the complex can also be estimated by comparing the individual thermal-phase-transfer temperature patterns for $\rho$ and $\sigma$ with those obtained for mixtures of $\rho$ and $\sigma$ mixed in stoichiometric integer ratios, and by finding any specific thermal property which apparently differs from the individual thermal-phase-transfer temperature patterns for $\rho$ and $\sigma$. The compounds $\rho$ and $\sigma$ merely kept in a mixed status without any interaction therebetween will simply show shifting of a peak of the phase transfer temperature depending on the mixing ratio thereof such as found in freezing point depression. On the other hand, most of the cases in which $\rho$ and $\sigma$ are kept in a complex forming status show another thermal transfer peak in a new temperature range. It is still also possible to confirm formation of the complex by comparing the individual FT-IR spectra for the complexes $\rho$ and $\sigma$, and thus confirming any shifting of the vibration absorption peak ascribable to the functional group responsible for such interaction.

The following paragraphs will describe specific examples of the compound represented by the formula (I). It is to be noted, however, the present invention is by no means limited by such examples.

Formula (V)
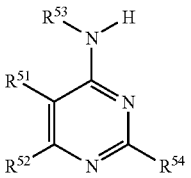
| | $R^{52}$=$R^{54}$ | $R^{51}$ $R^{53}$ |
|---|---|---|
| P-1 | 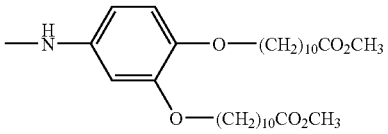 | H 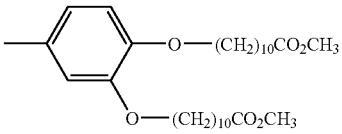 |
| P-2 | 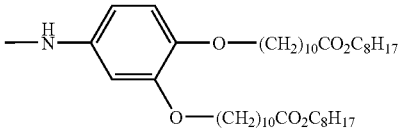 | H 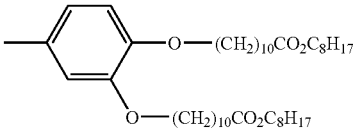 |
| P-3 | 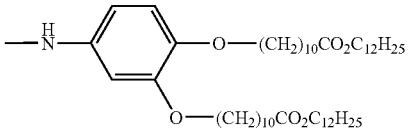 | H 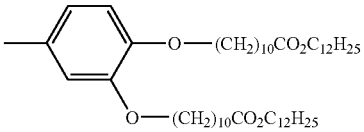 |
| P-4 | 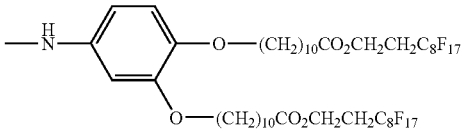 | H 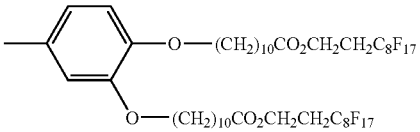 |
| P-5 | 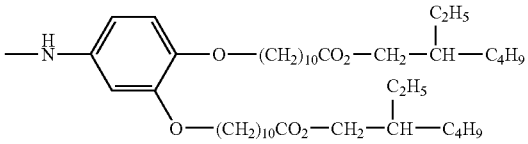 | H 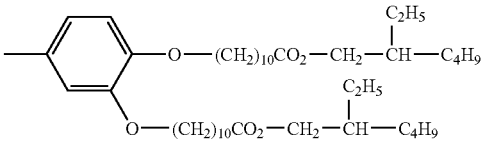 |
| P-6 | 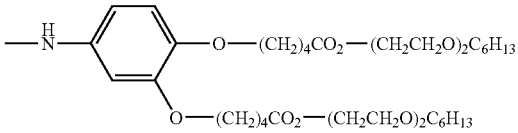 | H 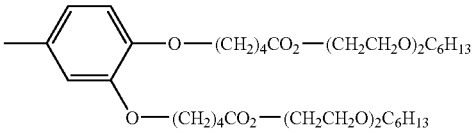 |
| P-7 | 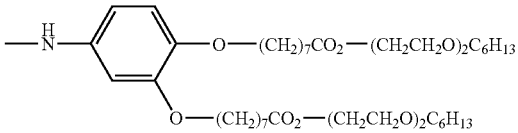 | H 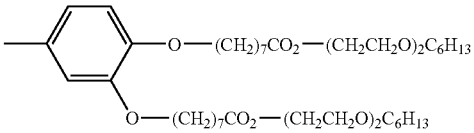 |
| P-8 | 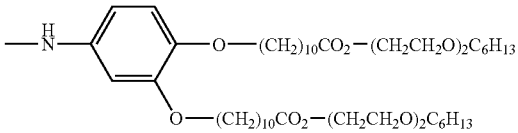 | H 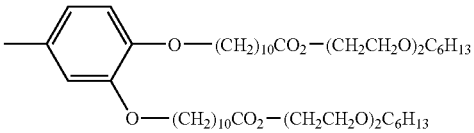 |
| P-9 | 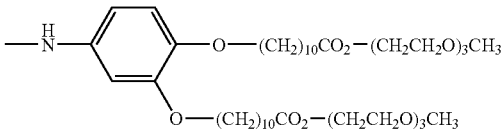 | H 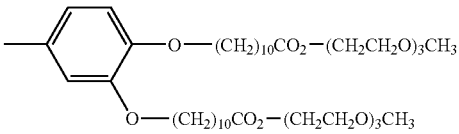 |

-continued
| | | |
|---|---|---|
| P-10 | 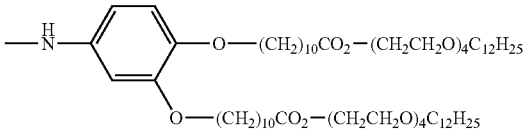 | H 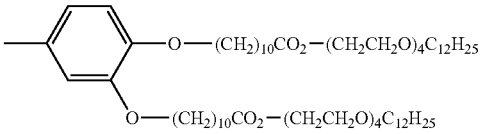 |
| P-11 | 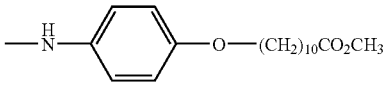 | H 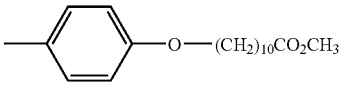 |
| P-12 | 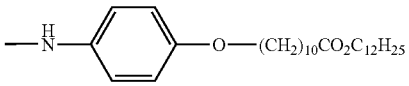 | H 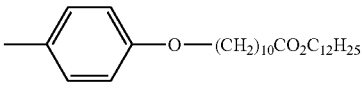 |
| P-13 | 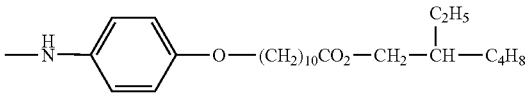 | H 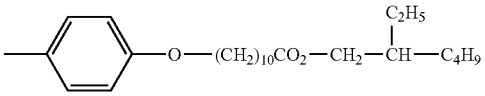 |
| P-14 | 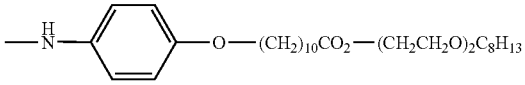 | H 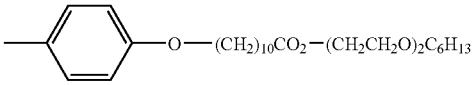 |
| P-15 | 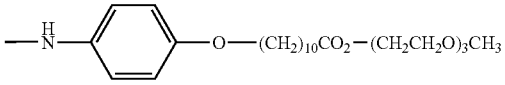 | H 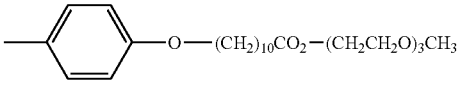 |
Formula (VII)
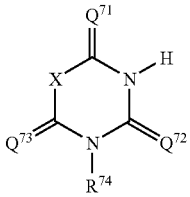
| | X | $Q^{71}$=$Q^{72}$=$Q^{73}$ | $R^{74}$ |
|---|---|---|---|
| B-1 | 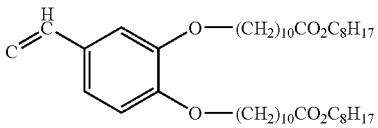 | O | H |
| B-2 | 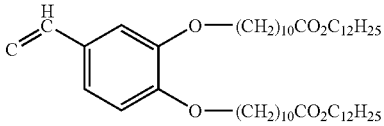 | O | H |
| B-3 | 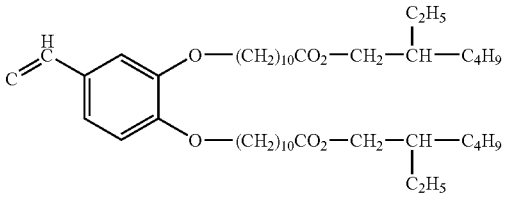 | O | H |
| B-4 | 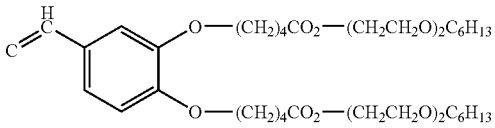 | O | H |

-continued
| | | | |
|---|---|---|---|
| B-5 | 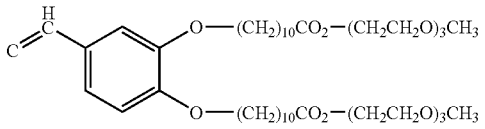 | O | H |
| B-6 | 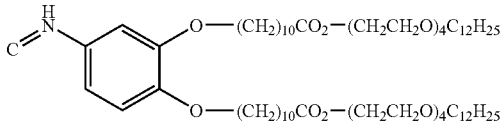 | O | H |
| B-7 | 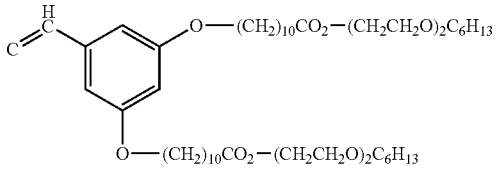 | O | H |
| B-8 | 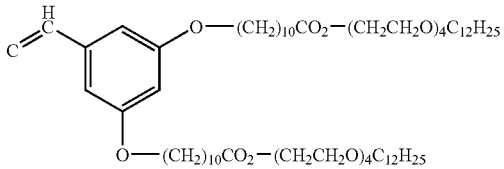 | O | H |
| B-9 | 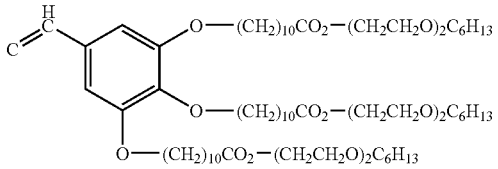 | O | H |
| B-10 | 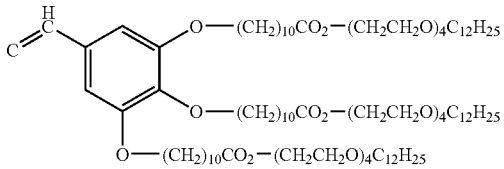 | O | H |
| B-11 | 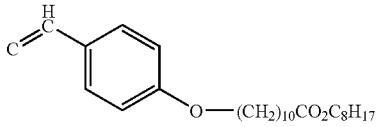 | O | H |
| B-12 | 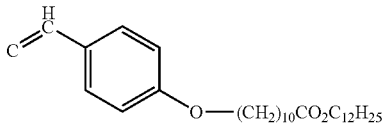 | O | H |
| B-13 | 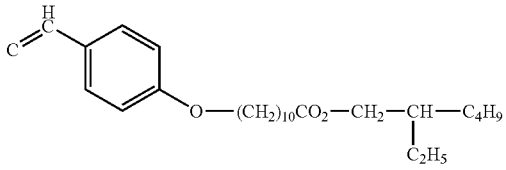 | O | H |
| B-14 | 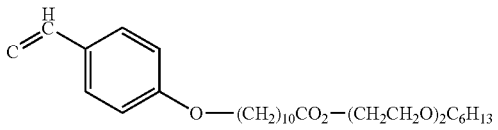 | O | H |

-continued
| | | | |
|---|---|---|---|
| B-15 | 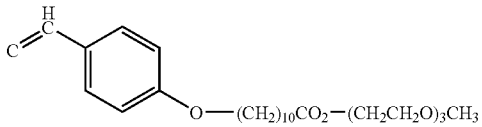 | O | H |
| B-16 | 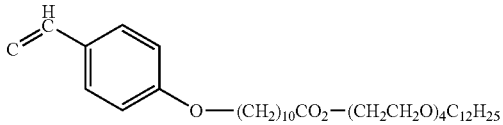 | O | H |
| B-17 | 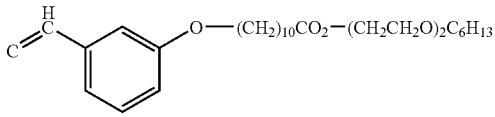 | O | H |
| B-18 | 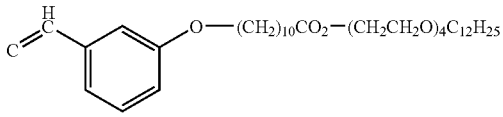 | O | H |
Formula (VIII)
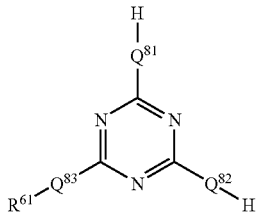
| | $Q^{81}$=$Q^{82}$ | $Q^{83}$ | $R^{81}$ |
|---|---|---|---|
| T-1 | 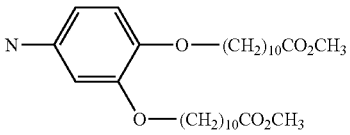 | S | 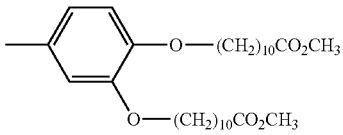 |
| T-2 | 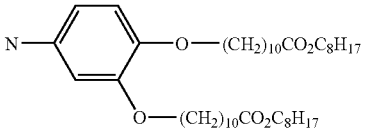 | S | 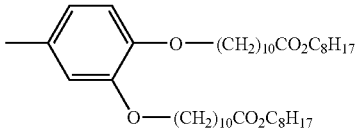 |
| T-3 | 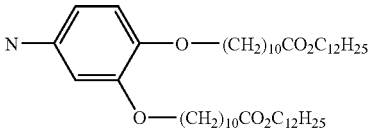 | S | 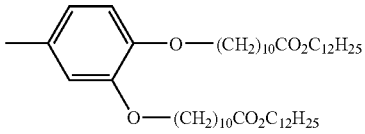 |
| T-4 | 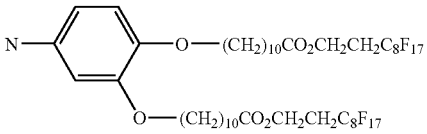 | S | 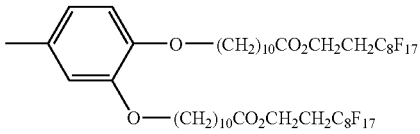 |
| T-5 | 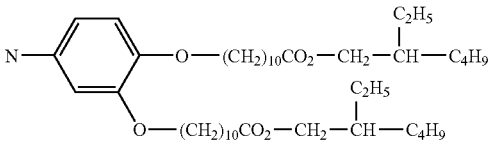 | S | 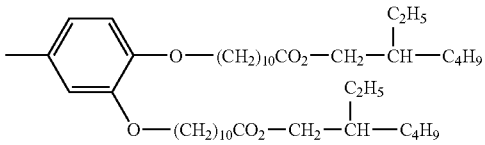 |

-continued
| | | | |
|---|---|---|---|
| T-6 | 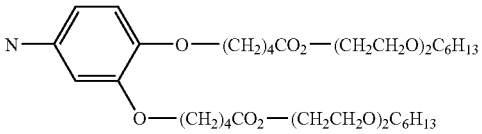 | S | 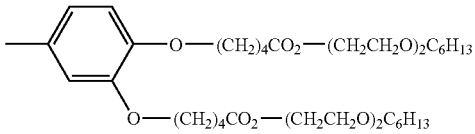 |
| T-7 | 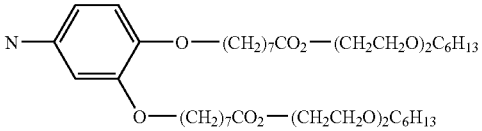 | S | 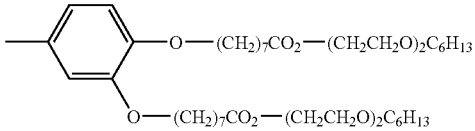 |
| T-8 | 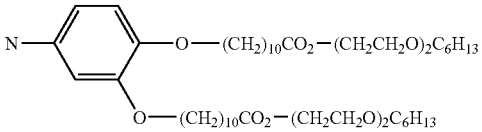 | S | 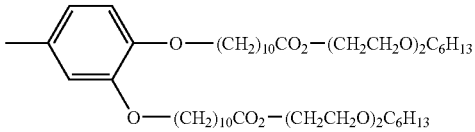 |
| T-9 | 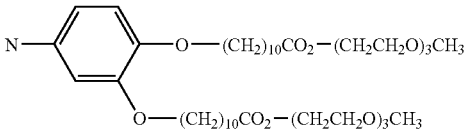 | S | 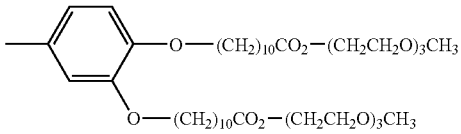 |
| T-10 | 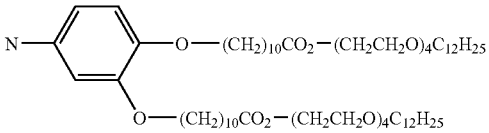 | S | 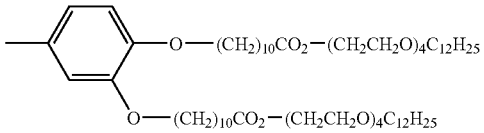 |
| T-11 | 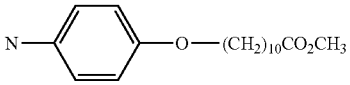 | S | 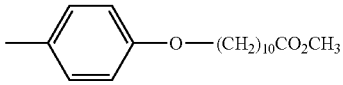 |
| T-12 | 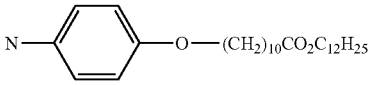 | S | 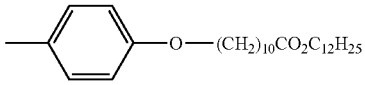 |
| T-13 | 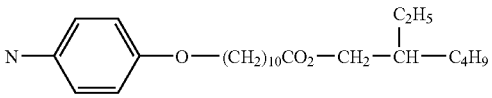 | S | 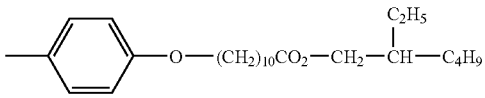 |
| T-14 | 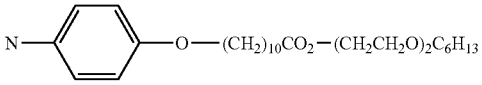 | S | 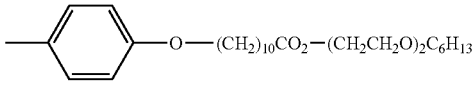 |
| T-15 | 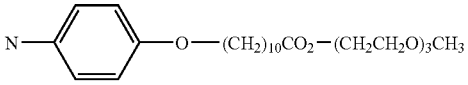 | S | 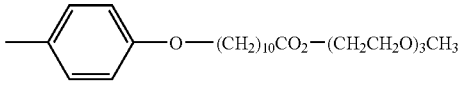 |
| T-16 | 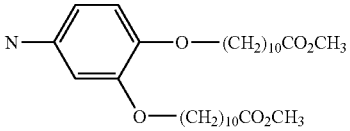 | O | 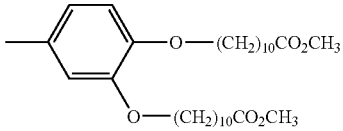 |
| T-17 | 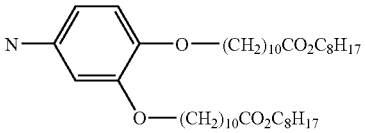 | O | 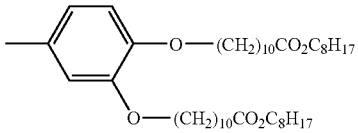 |

-continued
T-18
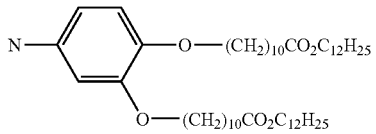
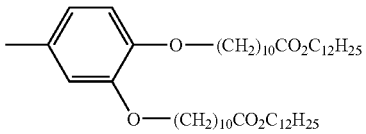
T-19
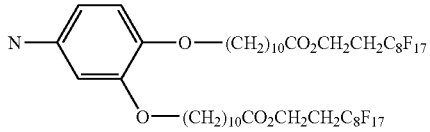
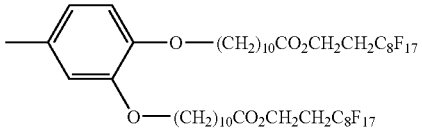
T-20
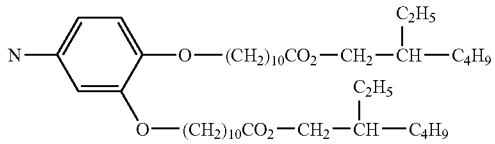
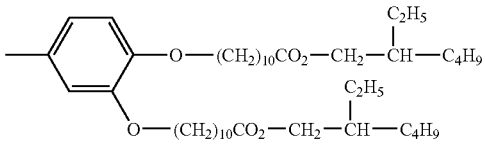
T-21
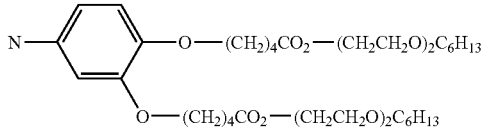
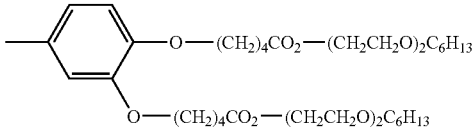
T-22
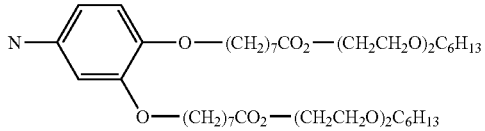
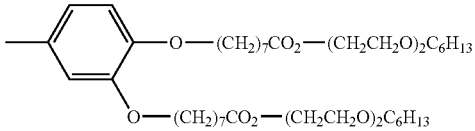
T-23
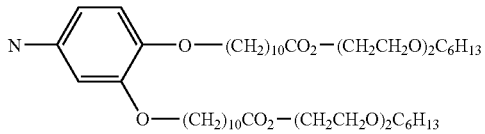
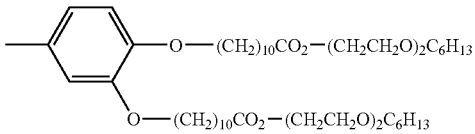
T-24
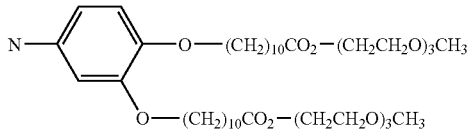
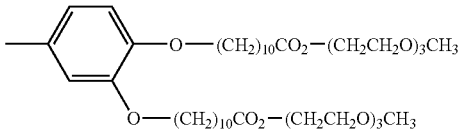
T-25
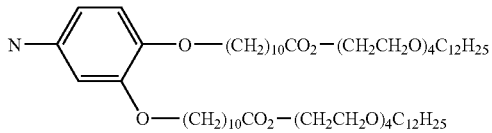
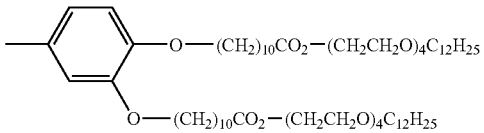
T-26
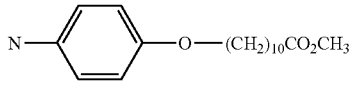
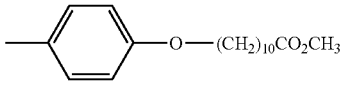
T-27
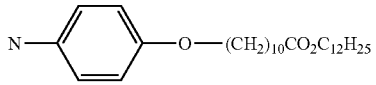
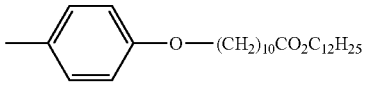
T-28
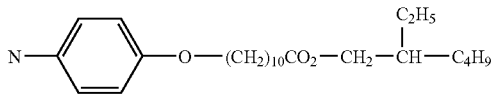
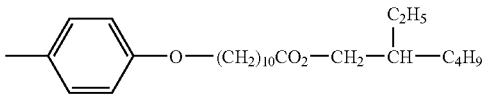
T-29
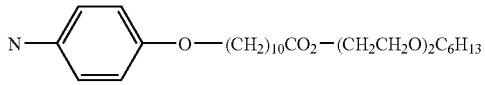
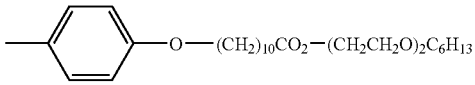

-continued
| | | | |
|---|---|---|---|
| T-30 | 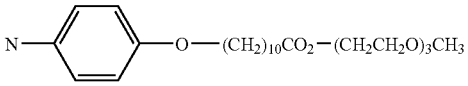 | O | 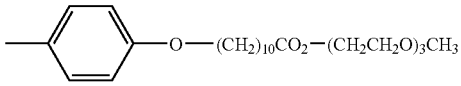 |
| T-31 | 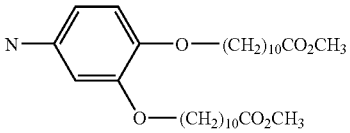 | N | 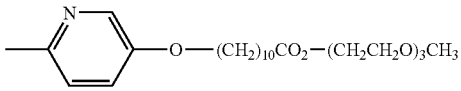 |
| T-32 | 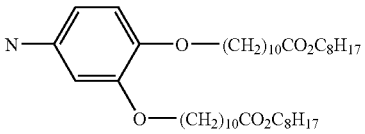 | N | 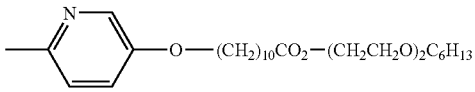 |
| T-33 | 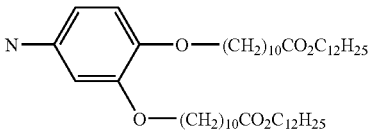 | N | 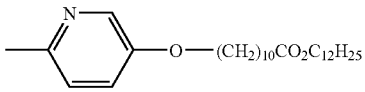 |
| T-34 | 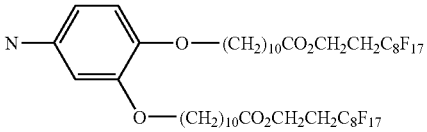 | N | 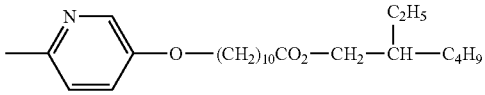 |
| T-35 | 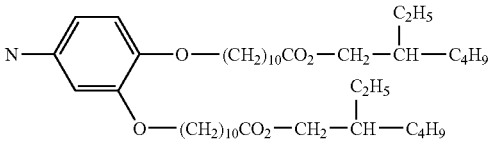 | N | 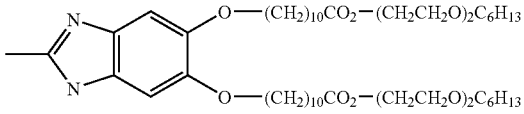 |
| T-36 | 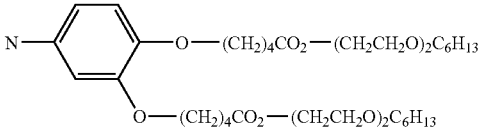 | N | 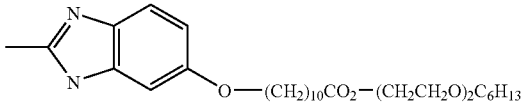 |
| T-37 | 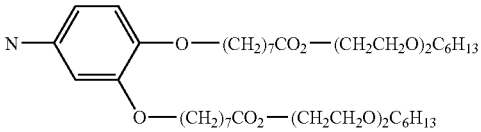 | S | 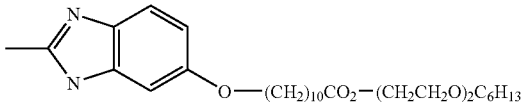 |
| T-38 | 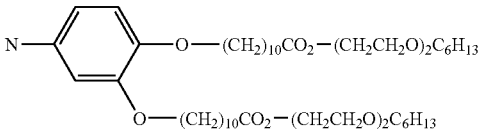 | O | 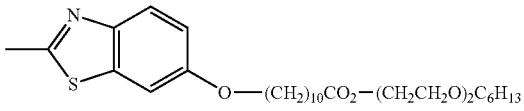 |
| T-39 | 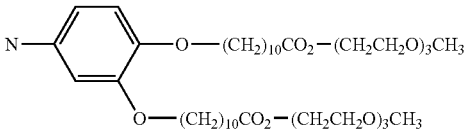 | S | 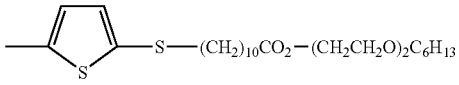 |
| T-40 | 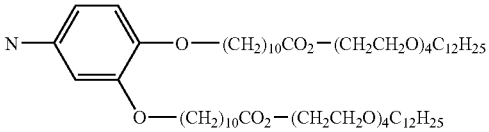 | S | 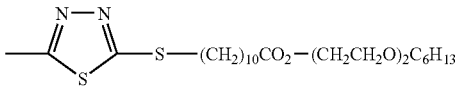 |

-continued
| | | |
|---|---|---|
| T-41 | 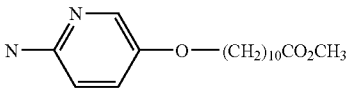 | NH 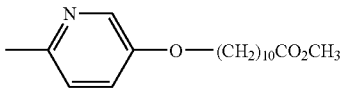 |
| T-42 | 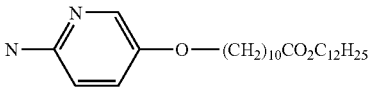 | NH 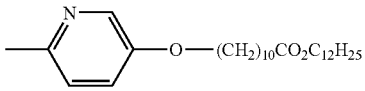 |
| T-43 | 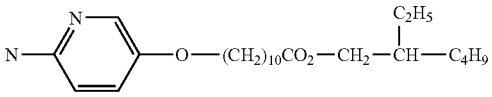 | NH 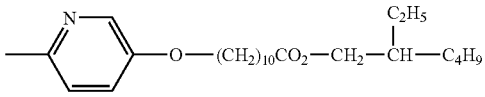 |
| T-44 | 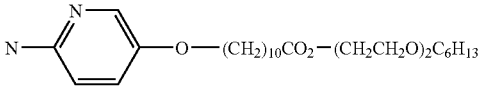 | NH 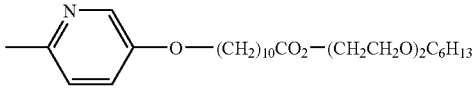 |
| T-46 | 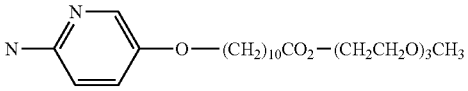 | NH 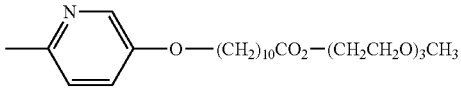 |
| T-47 | 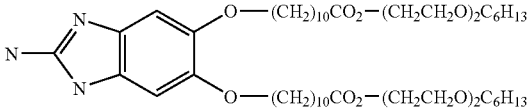 | NH 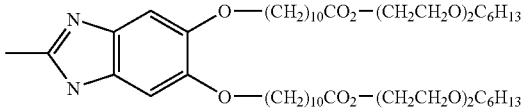 |
| T-48 | 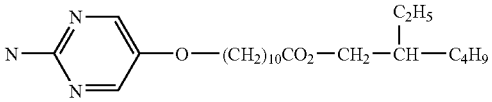 | NH 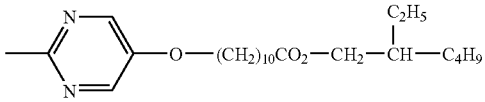 |
| T-49 | 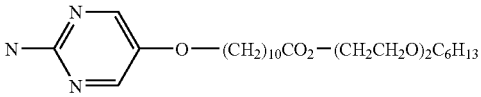 | NH 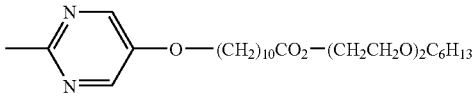 |
| T-50 | 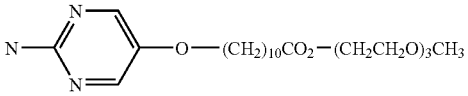 | NH 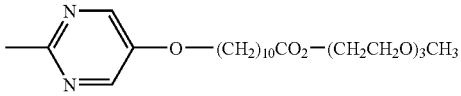 |
Formula (IX)
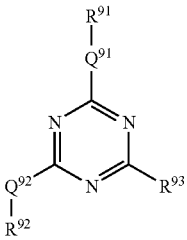
| | $R^{91}$=$R^{92}$ | $Q^{91}$=$Q^{92}$ | $R^{93}$ |
|---|---|---|---|
| T-51 | 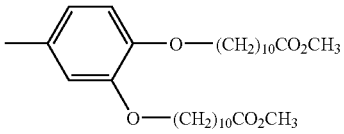 | NH | $NH_2$ |
| T-52 | 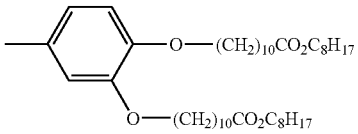 | NH | $NH_2$ |

-continued
| | | | |
|---|---|---|---|
| T-53 | 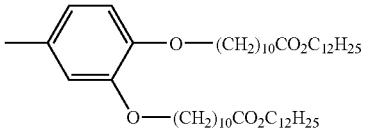 | NH | $NH_2$ |
| T-54 | 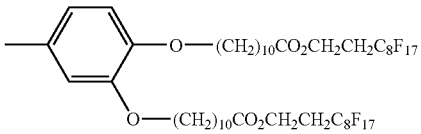 | NH | $NH_2$ |
| T-55 | 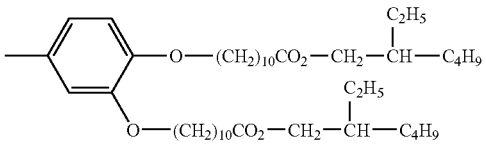 | NH | $NH_2$ |
| T-56 | 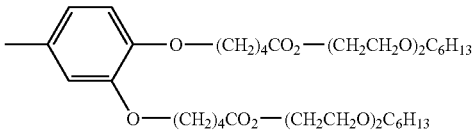 | NH | $NH_2$ |
| T-57 | 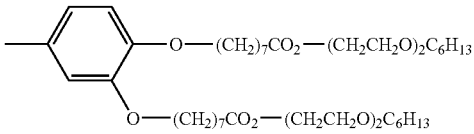 | NH | $NH_2$ |
| T-58 | 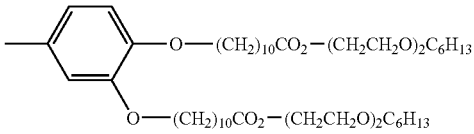 | NH | $NH_2$ |
| T-59 | 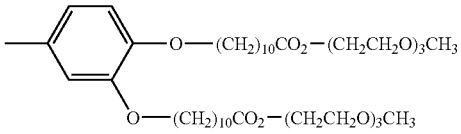 | NH | $NH_2$ |
| T-60 | 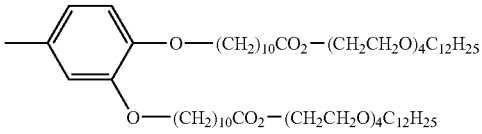 | NH | $NH_2$ |
| T-61 | 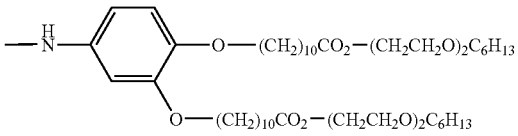 | NH | —OH |
| T-62 | 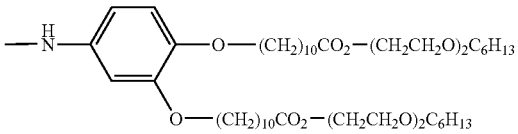 | NH | —SH |
| T-63 | 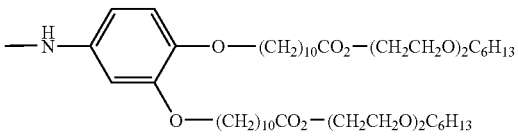 | NH | —Cl |

-continued
| | | | |
|---|---|---|---|
| T-64 | 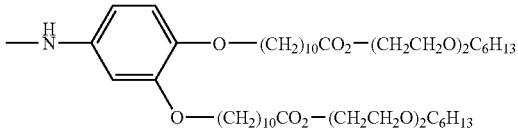 | NH | —I |
| T-65 | 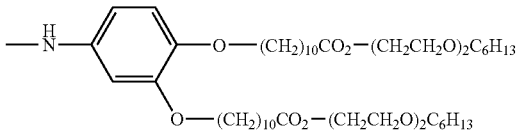 | NH | 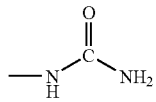 |
| T-66 | 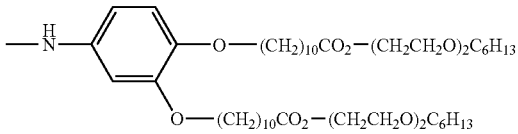 | NH | —COOH |
| T-67 | 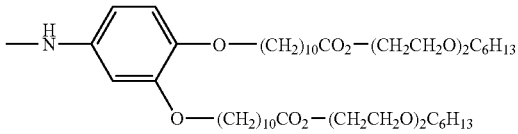 | NH | —NHOH |
The following paragraphs will describe specific examples of the molecular complex which contains the compound represented by the formula (XII). It is to be noted, however, the present invention is by no means limited by such examples.
Formula (XII)
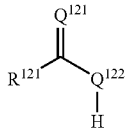
| | $R^{121}$ | $Q^{121}$=$Q^{122}$ |
|---|---|---|
| A-1 | 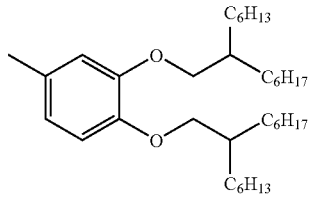 | O |
| A-2 | 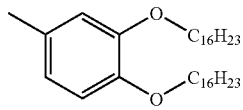 | O |
| A-3 | 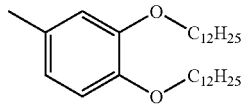 | O |
| A-4 | 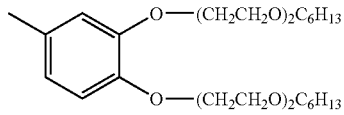 | O |

-continued
Formula (XII)
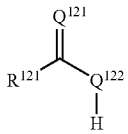
| | $R^{121}$ | $Q^{121}$=$Q^{122}$ |
|---|---|---|
| A-5 | 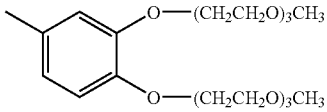 | O |
| A-6 | 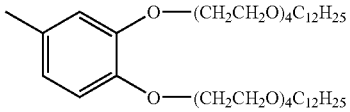 | O |
| A-7 | 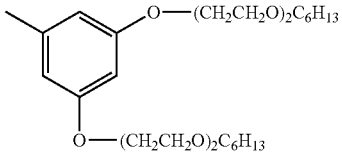 | O |
| A-8 | 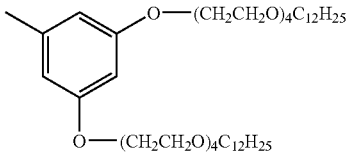 | O |
| A-9 | 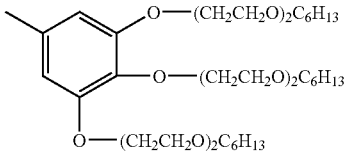 | O |
| A-10 | 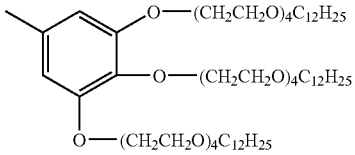 | O |
| A-11 | 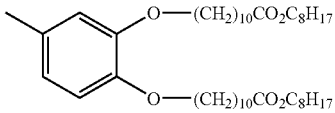 | O |
| A-12 | 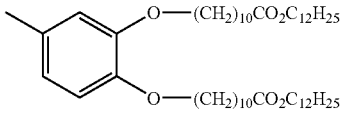 | O |
| A-13 | 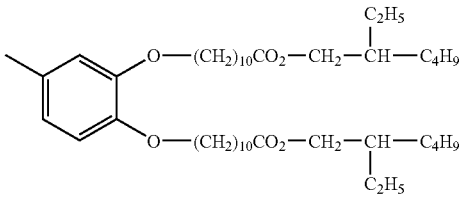 | O |

-continued
Formula (XII)
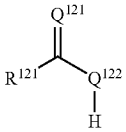
| | $R^{121}$ | $Q^{121}$=$Q^{122}$ |
|---|---|---|
| A-14 | 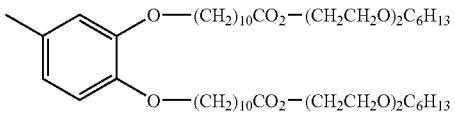 | O |
| A-15 | 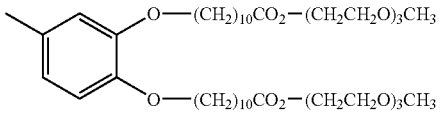 | O |
| A-16 | 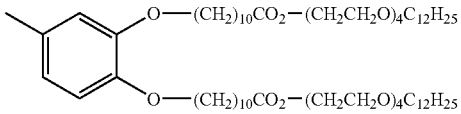 | O |
| A-17 | 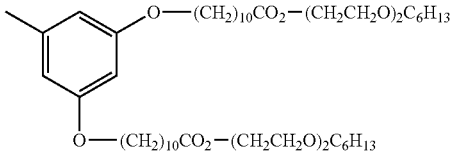 | O |
| A-18 | 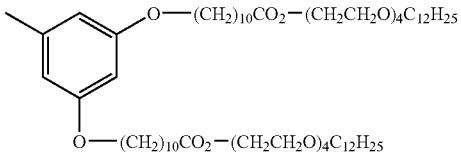 | O |
| A-19 | 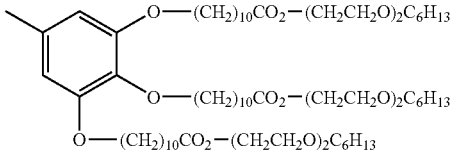 | O |
| A-20 | 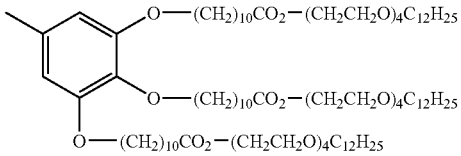 | O |
| A-21 | 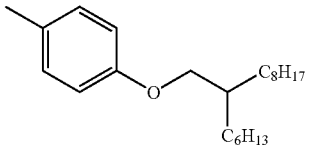 | O |
| A-22 | 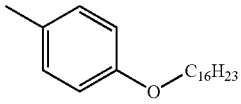 | O |

-continued
Formula (XII)
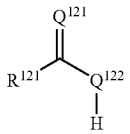
| | $R^{121}$ | $Q^{121}$=$Q^{122}$ |
|---|---|---|
| A-23 | 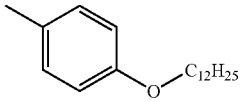 | O |
| A-24 | 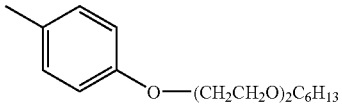 | O |
| A-25 | 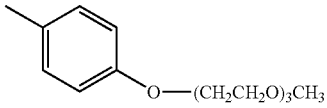 | O |
| A-26 | 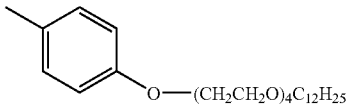 | O |
| A-27 | 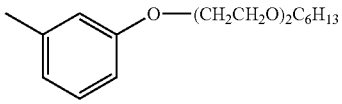 | O |
| A-28 | 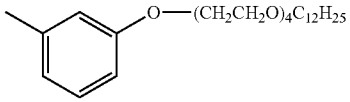 | O |
| A-29 | 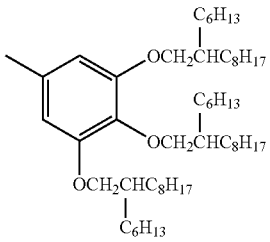 | O |
| A-30 | 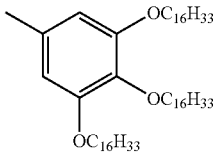 | O |
| A-31 | 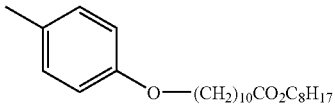 | O |
| A-32 | 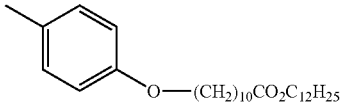 | O |

-continued

Formula (XII)

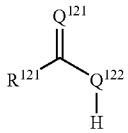

| | $R^{121}$ | $Q^{121}$=$Q^{122}$ |
|---|---|---|
| A-33 | 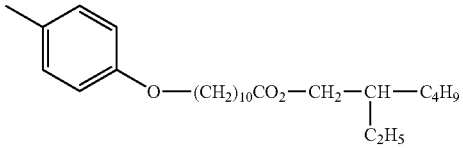 | O |
| A-34 | 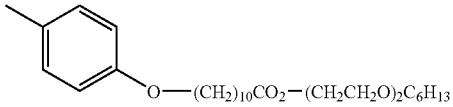 | O |
| A-35 | 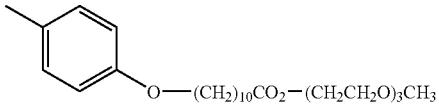 | O |
| A-36 | 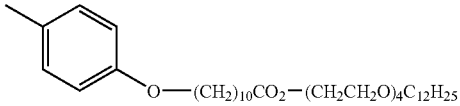 | O |
| A-37 | 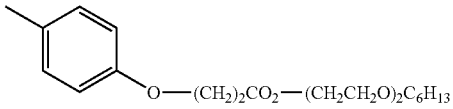 | O |
| A-38 | 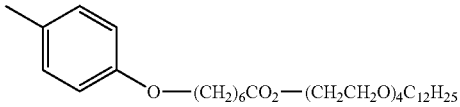 | O |
| A-39 | 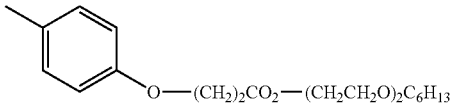 | O |
| A-40 | 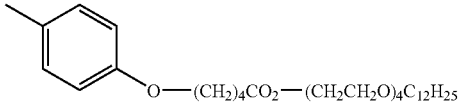 | O |

Examples of the molecular complex which is formed of a combination of a molecule represented by the formula (I) and other molecule represented by the formula (XII) are shown in Table 1 to 4. The combination thereof satisfies the foregoing conditions (1) to (5). In the tables, the examples (L) of the molecular complex are identified by reference numbers of the specific examples represented by formula (I) or (XII). It is noted that the molar ratios of two components in the exemplified complexes are 1/1 (mol/mol).

TABLE 1

| Molecular Complex No. | Formula |
|---|---|
| L-1 | T-1/A-4 |
| L-2 | T-2/A-4 |

TABLE 1-continued

| Molecular Complex No. | Formula |
|---|---|
| L-3 | T-3/A-4 |
| L-4 | T-4/A-4 |
| L-5 | T-5/A-4 |
| L-6 | T-5/A-6 |
| L-7 | T-5/A-7 |
| L-8 | T-5/A-8 |
| L-9 | T-5/A-9 |
| L-10 | T-5/A-10 |
| L-11 | T-8/A-1 |
| L-12 | T-8/A-2 |
| L-13 | T-8/A-3 |
| L-14 | T-8/A-4 |
| L-15 | T-8/A-5 |
| L-16 | T-10/A-6 |
| L-17 | T-10/A-7 |
| L-18 | T-10/A-8 |
| L-19 | T-10/A-9 |
| L-20 | T-10/A-10 |
| L-21 | T-8/B-1 |
| L-22 | T-8/B-2 |
| L-23 | T-8/B-3 |
| L-24 | T-8/B-4 |
| L-25 | T-8/B-5 |
| L-26 | T-8/B-6 |
| L-27 | T-8/B-7 |
| L-28 | T-8/B-8 |
| L-29 | T-8/B-9 |
| L-30 | T-8/B-10 |

TABLE 2

| Molecular Complex No. | Formula |
|---|---|
| L-31 | T-11/A-4 |
| L-32 | T-12/A-4 |
| L-33 | T-13/A-4 |
| L-34 | T-14/A-4 |
| L-35 | T-15/A-4 |
| L-36 | T-15/A-6 |
| L-37 | T-15/A-7 |
| L-38 | T-15/A-8 |
| L-39 | T-15/A-9 |
| L-40 | T-15/A-10 |
| L-41 | T-11/A-17 |
| L-42 | T-12/A-17 |
| L-43 | T-13/A-17 |
| L-44 | T-14/A-17 |
| L-45 | T-15/A-17 |
| L-46 | T-14/B-1 |
| L-47 | T-14/B-2 |
| L-48 | T-14/B-3 |
| L-49 | T-14/B-4 |
| L-50 | T-14/B-5 |
| L-51 | T-14/B-11 |
| L-52 | T-14/B-12 |
| L-53 | T-14/B-13 |
| L-54 | T-14/B-14 |
| L-55 | T-14/B-15 |
| L-56 | T-29/B-6 |
| L-57 | T-29/B-7 |
| L-58 | T-29/B-8 |
| L-59 | T-29/B-9 |
| L-60 | T-29/B-10 |

TABLE 3

| Molecular Complex No. | Formula |
|---|---|
| L-61 | T-31/A-4 |
| L-62 | T-32/A-4 |
| L-63 | T-33/A-4 |
| L-64 | T-34/A-4 |
| L-65 | T-35/A-4 |
| L-66 | T-35/A-6 |
| L-67 | T-35/A-7 |
| L-68 | T-36/B-5 |
| L-69 | T-36/B-7 |
| L-70 | T-36/B-9 |
| L-71 | T-41/A-4 |
| L-72 | T-42/A-4 |
| L-73 | T-43/A-4 |
| L-74 | T-44/A-4 |
| L-75 | T-46/A-4 |
| L-76 | T-46/A-6 |
| L-77 | T-46/A-7 |
| L-78 | T-46/A-8 |
| L-79 | T-46/A-9 |
| L-80 | T-46/A-10 |
| L-81 | T-48/B-1 |
| L-82 | T-48/B-2 |
| L-83 | T-48/B-3 |
| L-84 | T-48/B-4 |
| L-85 | T-48/B-5 |
| L-86 | T-48/B-6 |
| L-87 | T-48/B-7 |
| L-88 | T-48/B-8 |
| L-89 | T-48/B-9 |
| L-90 | T-48/B-10 |

TABLE 4

| Molecular Complex No. | Formula |
|---|---|
| L-91 | T-51/A-4 |
| L-92 | T-52/A-4 |
| L-93 | T-53/A-4 |
| L-94 | T-54/A-4 |
| L-95 | T-55/A-4 |
| L-96 | T-56/A-6 |
| L-97 | T-57/A-7 |
| L-98 | T-58/A-8 |
| L-99 | T-59/A-9 |
| L-100 | T-60/A-10 |
| L-101 | T-41/A-4 |
| L-102 | T-42/A-4 |
| L-103 | T-43/A-4 |
| L-104 | T-44/A-4 |
| L-105 | T-46/A-4 |
| L-106 | T-41/B-6 |
| L-107 | T-42/B-7 |
| L-108 | T-43/B-8 |
| L-109 | T-44/B-9 |
| L-110 | T-46/B-10 |
| L-111 | P-1/B-1 |
| L-112 | P-2/B-2 |
| L-113 | P-3/B-3 |
| L-114 | P-4/B-4 |
| L-115 | P-5/B-5 |
| L-116 | P-6/B-6 |
| L-117 | P-7/B-7 |
| L-118 | P-8/B-8 |
| L-119 | P-9/B-9 |
| L-120 | P-10/B-10 |

The compound represented by the formula (I) and the other compound capable of forming a molecular complex therewith can be synthesized by properly combining known methods for manufacturing.

The molecular complex used for the lubricant composition of the present invention can be used as a lubricant alone, and also used in a mixed form with a lubricant base oil as a lubricant aids.

The lubricant base oil is not specifically be limited, and any of those generally used as a lubricant base oil will be available, which is exemplified by mineral oil, synthetic oil and any mixed oils thereof. Possible examples of such lubricant base oil include solvent-refined raffinate obtained by extracting a source oil, which is derived from a paraffin-base, intermediate-base or naphthene-base crude oil by distillation under atmospheric or reduced pressure, using an aromatic solvent such as phenol, furfural or N-methylpyrrolidone; hydrogenated oil obtained by treating the source oil with hydrogen under hydrogenation conditions in the presence of hydrogenation catalyst such as cobalt or molybdenum immobilized on silica-alumina support; isomerized oil obtained by treating the source oil with hydrogen under severe decomposition reaction conditions in the presence of hydrogenation decomposition catalyst; and fraction of lubricating oil obtained by a combined process of solvent refining and hydrogenation of the source oil, or by a combined process of hydrogenation and isomerization or the like. In particular, those obtained by a combined process of hydrogenation and isomerization or the like, having high viscosity index, are preferable. Any of such manufacturing methods can arbitrarily be added with the individual processes for dewaxing, hydrogenation finishing and clay treatment. The mineral oil can also be classified into soft neutral oil, medium neutral oil, heavy neutral oil and bright stock, which can properly be mixed depending on target performances.

The synthetic oil can be exemplified by poly(α-olefin), α-olefin oligomer, polybutene, alkylbenzene, polyol ester, dibasic acid ester, polyoxyalkylene glycol, polyoxyalkylene glycol ether and silicone oil. These mineral oils and synthetic oils may be used independently or in any combinations of two or more thereof. It is also allowable to use mineral oil and synthetic oil in combination. Such lubricant base oil generally has a kinematic viscosity of 2 to 20 $mm^2/s$ at 100° C., and preferably 3 to 15 $mm^2/s$. It is allowable to properly select a mixed base oil having an optimum kinematic viscosity so as to well suit to lubricating conditions for mechanical fiction sliding member to which the lubricant composition of the present invention is applied.

For the embodiment of a mixture of the foregoing molecular complex and a lubricant base oil, preferable amount of such molecular complex is 0.01 wt % or above of the total weight of the lubricant base oil, more preferably 0.01 to 10 wt %, and still more preferably 0.05 to 5 wt %. The amount of the lubricant base oil is preferably 50 wt % or above. For the embodiment not containing lubricant base oil, the amount of the molecular complex is preferably 50 wt % or above, more preferably from 80 wt % or above and much more preferably 90 wt % or above.

The lubricant composition of the present invention may further comprise any known additives having been used for conventional lubricant such as bearing oil, gear oil and power transmission oil, in order to attain practical performances adopted for the individual applications within a range not adversely affecting the effects of the present invention, where such additives include wear preventive agent, extreme pressure agent, antioxidant, viscosity index raising agent, clean dispersion aid, metal passivation agent, corrosion preventive agent, rust preventive agent, and defoaming agent.

The lubricant composition of the present invention can be prepared by adding "n" (n is an integer of 1 or above) kinds of compounds capable of tautomerization, represented by the formula (I) (but excluding any compound represented by the foregoing formula (TAM)), having at least one ester bond and at least one functional group capable of tautomerization to thereby produce a molecular complex composed of such "n" kinds of the compounds. For example, a lubricant composition having a form of mixture with a lubricant base oil can be prepared by adding "n" (n is an integer of 1 or above) kinds of compounds capable of tautomerization represented by the formula (I) to a lubricant base oil to thereby form the molecular complex within such base oil. It is also allowable to preliminarily form the molecular complex and to add thus produced complex to the base oil. On the other hand, for the case without using the base oil, the lubricant composition can be prepared by mixing two or more compounds capable of tautomerization represented by the formula (I) to thereby form the molecular complex.

The lubricant composition comprising a molecular complex formed of at least one (thio)carboxylic acid and at least one compound capable of tautomerization represented by the formula (I) (but excluding any compound represented by the foregoing formula (TAM)) may be prepared by adding at least one compound represented capable of tautomerization by the formula (I) (but excluding any compound represented by the foregoing formula (TAM)) and at least one compound capable of tautomerization represented by the formula (XII). For a lubricant composition having a form of a mixture with a base oil, (thio) carboxylic acid and the compound represented by the foregoing compound represented by the formula (I) may preliminarily be mixed to thereby produce the molecular complex formed of both compounds and is then added to a base oil, or may independently be added to the base oil and the both are then mixed to thereby form the molecular complex within such lubricant base oil.

When supplied on the sliding surfaces which relatively move under contact with each other, the lubricant composition of the present invention can beneficially lower the friction coefficient of such sliding surfaces and improve the wear resistance of such sliding surfaces. What is better, such effects are maintained for a long period. The lubricant composition of the present invention can successfully reduce burn-in, improve wear resistance and keep the friction coefficient low even when it is supplied onto the surface moving under a friction condition which is severe enough for the conventional lubricating oil or lubricant such as grease to cause breakage of the oil film. For example, the lubricant composition of the present invention can preferably be used as an energy-saving lubricant for bearings or gears which move under severe friction conditions, and can further contribute to improvement in the reliability and downsizing of sliding members. The lubricant composition of the present invention has specific features of low friction coefficient, high wear resistance and extreme pressure properties under severe lubricating conditions. The lubricant composition of the present invention can successfully maintain a sufficient level of viscosity even under temperature as low as −40° C., if the various compounds capable of tautomerization are properly selected and mixed, which allows use of such composition under low temperatures and adds practical value thereof.

EXAMPLES

The present invention will more specifically be explained referring to preferred examples. It is to be noted that materials, reagents, ratio of use thereof, and operation can properly be modified without departing from the spirit of the present invention. Therefore the scope of the present invention is by no means limited to the preferred examples described below.

Lubricant compositions of Example Nos. 1 to 8, shown in Table 5 below, were prepared by respectively using Compound L-14, Compound L-70, Compound L-77 and Compound L-116, which fall within the scope of the Formula (1), alone or in combinations with lubricant base oil. And lubricant compositions of Comparative Example Nos. 1 to 8, shown in Table 6 below, were prepared by using lubricant oil alone or in combinations with Comparative Compounds M-1 or M-2 shown below.

The obtained compositions were subjected to reciprocating type (SRV) friction wear test under conditions listed below in order to evaluate friction coefficient.

[Test Conditions]

Tests were subjected under Cylinder on Plate Test.

Specimen (friction material): SUJ-2

Plate: 24 mm in diameter, 6.9 mm thick

Cylinder: 11 mm in diameter, 15 mm long

Temperature: 90° C.

Load: 400 N

Amplitude: 1.5 mm

Frequency: 50 Hz

Testing period: for 5 min. after the start of testing

The results of Example Nos. 1 to 8 are shown in Table 5 and the results of Comparative Example Nos. 1 to 8 were shown in Table 6.

TABLE 5

| | | Example 1 | Example 2 | Example 3 | Example 4 | Example 5 | Example 6 | Example 7 | Example 8 |
|---|---|---|---|---|---|---|---|---|---|
| Compound of the present invention | Exemplified Compound No. | L-14 | L-70 | L-77 | L-116 | L-14 | L-70 | L-77 | L-126 |
| | wt % | 100 | 100 | 100 | 100 | 5 | 5 | 5 | 5 |
| Lubricant base oil wt % | Pentaerythritol ester*1 | — | — | — | — | 95 | — | — | — |
| | Alkylbenzene*2 | — | — | — | — | — | 95 | — | — |
| | Naphthene-base mineral oil | — | — | — | — | — | — | 95 | — |
| | Paraffin-base mineral oil | — | — | — | — | — | — | — | 95 |
| Friction cofeccient | SRV friction wear test at 400 N, 90° C. | 0.03 | 0.03 | 0.03 | 0.03 | 0.07 | 0.08 | 0.07 | 0.08 |

*1Hexanoic acid ester of pentaerythritol
*2Alkylbenzene having $C_{10}$ alkyl groups

TABLE 6

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Comparative Compound | No. | — | — | — | — | M-1 | M-2 | M-1 | M-2 |
| | wt % | | | | | 100 | 100 | 5 | 5 |
| Lubricant base oil wt % | Pentaerythritol ester *1 | 100 | — | — | — | — | — | 95 | — |
| | Alkylbenzene *2 | — | 100 | — | — | — | — | — | 95 |
| | Naphthene-base mineral oil | — | — | 100 | — | — | — | — | — |
| | Paraffin-base mineral oil | — | — | — | 100 | — | — | — | — |
| Friction cofeccient | SRV friction wear test at 400 N, 90° C. | 0.2 | 0.22 | 0.24 | 0.22 | 0.05 | 0.05 | 0.09 | 0.09 |

*1 Hexanoic acid ester of pentaerythritol
*2 Alkylbenzene having $C_{10}$ alkyl groups Comparative compound (M-1)

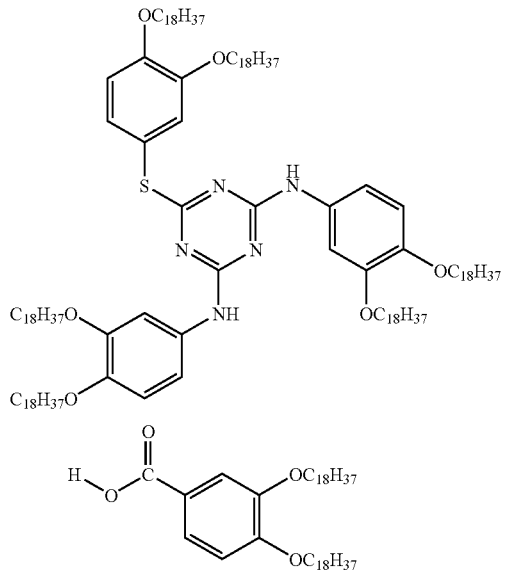

-continued

Comparative compound (M-2)

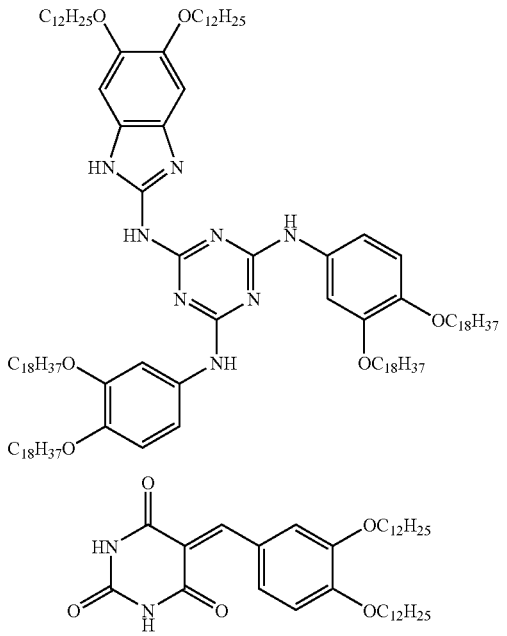

As has been described in the above, the present invention is successful in providing a lubricant composition capable of exhibiting excellent properties not only in a state of mixture with conventional lubricant base oil, but also in a state not mixed with such lubricant base oil, and a method for preparing thereof. The present invention is also successful in providing a lubricant composition capable of retaining low friction property and high wear resistance on the sliding surface for a long period, and a method for preparing thereof. The present invention is further successful in providing a lubricant composition capable of readily forming a uniform thin film, and being applicable to the surface of magnetic recording media or invention is still further successful in providing a lubricant composition excluding environmentally-less-compatible heavy metals, phosphate group and sulfides to thereby concomitantly achieve both of longer service life and environmental compatibility, and a method for preparing thereof. And the present invention can also provide molecular complexes which are useful as extreme pressure agents, friction coefficient modifiers and anti-wear additives.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A lubricant composition comprising a molecular complex formed by intermolecular interaction between molecules capable of tautomerization, wherein at least one of the molecules has at least one ester bond and is represented by any one of the formulae (III) to (XI) (but excluding any compound represented by the formula (TAM) below):

forumula (III)

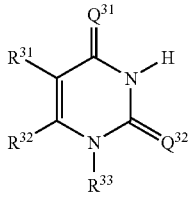

where, $R^{31}$ to $R^{33}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{31}$ and $Q^{32}$ independently represent an oxygen atom or a sulfur atom; $R^{31}$ and $R^{32}$, or $R^{32}$ and $R^{33}$ may bind with each other to thereby form a cyclic structure;

formula (IV)

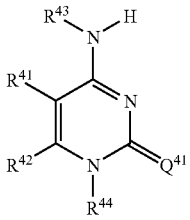

where, $R^{41}$ to $R^{44}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{41}$ and represents an oxygen atom or a sulfur atom; $R^{41}$ and $R^{42}$, $R^{41}$ and $R^{43}$, or $R^{42}$ and $R^{44}$ may bind with each other to thereby form a cyclic structure;

formula (V)

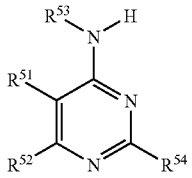

where, $R^{51}$ to $R^{54}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{51}$ and $R^{52}$, or $R^{51}$ and $R^{53}$ may bind with each other to thereby form a cyclic structure;

formula (VI)

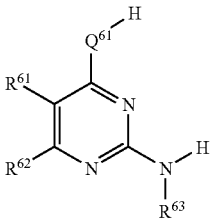

where, $R^{61}$ to $R^{63}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{61}$ represents an oxygen atom or sulfur atom; $R^{61}$ and $R^{62}$ may bind with each other to thereby form a cyclic structure;

formula (VII)

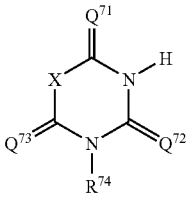

where, $Q^{71}$ to $Q^{73}$ independently represents an oxygen atom or a sulfur atom; X represents —C(=$R^{71}$)— or —C($R^{72}$)($R^{73}$)—; $R^{71}$ represents a substituent; $R^{72}$ to $R^{74}$ independently represents a hydrogen atom or a substituent; at least one of $R^{71}$ to $R^{74}$ represents a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{72}$ and $R^{73}$ may bind with each other to thereby form a cyclic structure;

formula (VIII)

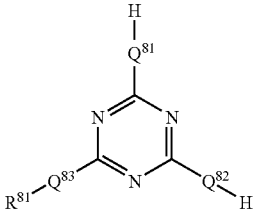

where, $Q^{81}$ to $Q^{83}$ independently represents an oxygen atom, a sulfur atom or N($R^{82}$); $R^{81}$ and $R^{82}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{81}$ and $R^{82}$ may bind with each other to thereby form a cyclic structure when $Q^{83}$ represents N($R^{82}$);

formula (IX)

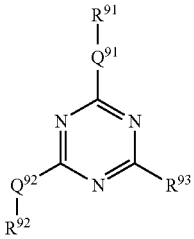

where, $Q^{91}$ and $Q^{92}$ independently represents a single bond, N($R^{94}$) where $R^{94}$ represents a hydrogen or $C_{1-30}$ alkyl group, oxygen atom, sulfur atom, carbonyl, sulfonyl, or any combination thereof; $R^{91}$ and $R^{92}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{93}$ represents a halogen atom, hydroxyl, amino, mercapto, cyano, sulfide, carboxyl or a salt thereof, sulfo or a salt thereof, hydroxyamino, ureido, or urethane;

formula (X)

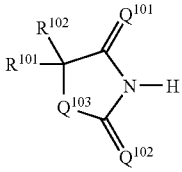

where, $Q^{101}$ to $Q^{103}$ independently represents an oxygen atom, sulfur atom or N($R^{103}$); $R^{101}$ to $R^{103}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; and formula (XI)

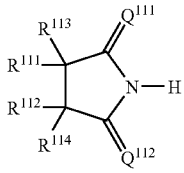

where, $Q^{111}$ and $Q^{112}$ independently represents an oxygen atom, sulfur atom or N($R^{115}$); $R^{111}$ to $R^{115}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{111}$ and $R^{113}$, $R^{113}$ and $R^{114}$, $R^{113}$ and $R^{115}$, $R^{112}$ and $R^{114}$, or $R^{114}$ and $R^{115}$ may bind with each other to thereby form a cyclic structure; and wherein said at least one of the molecules having at least one ester bond has a group represented by formula (c):

formula (c)

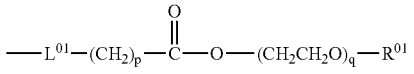

where, $L^{01}$ represents a bivalent linking group selected from the group consisting of an alkylene group, $NR^1$, where $R^1$ is a hydrogen atom or $C_{1-30}$ alkyl group, oxygen, sulfur, carbonyl, sulfonyl or any combinations thereof; $R^{01}$ represents a substituted or non-substituted $C_{1-30}$ alkyl group; p represents an integer from 1 to 20; and q represents and integer from 1 to 10, and formula (TAM)

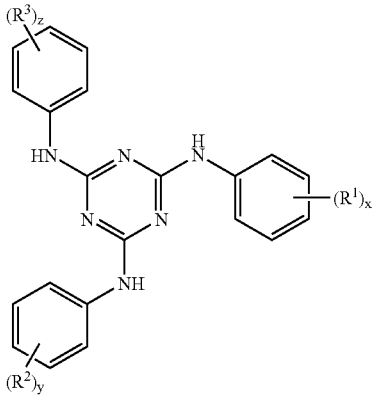

where $R^1$, $R^2$ and $R^3$ independently represents a substituent; x, y and z independently represent an integer of 1 to 5.

2. The lubricant composition of claim 1, wherein the molecules can interact with each other via a functional group capable of tautomerization in a geometrically complementary positional relation such that the molecular complex has a planar structure.

3. The lubricant composition of claim 1, wherein the molecular complex is formed of "n" (n is an integer of 1 or above) kinds of molecules $A_1$ to $A_n$ capable of tautomerization represented by any one of the formulae (III) to (XI) (but excluding any compound represented by the foregoing formula (TAM)).

4. The lubricant composition of claim 1, wherein the molecular complex is formed of at least one molecule represented by any one of the formulae (III) to (XI) (but excluding any compound represented by the foregoing formula (TAM)), and at least one molecule represented by the formula (XII):

formula (XII)

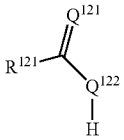

where, $R^{121}$ represents a substituent; $Q^{121}$ and $Q^{122}$ independently represents an oxygen atom or a sulfur atom.

5. The lubricant composition of claim 1, wherein the molecule capable of tautomerization represented by the formula (I) shows a pKa of 2 to 12.

6. The lubricant composition of claim 1, wherein the molecular complex shows a thermal phase transfer temperature pattern, which is measured by the differential scanning calorimetry (DSC), differing from those shown by the component compounds thereof.

7. The lubricant composition of claim 1, further containing a lubricant base oil in an amount of 50 wt % or more.

8. A method for preparing lubricant composition comprising a step of adding "n" (n is an integer of 1 or above) kinds of compounds represented by any one of the following formula (III) to (XI) (but excluding any compound represented by the following formula (TAM) below) to a lubricant base oil:

formula (III)

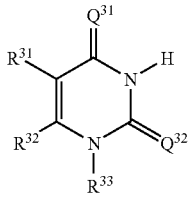

where, $R^{31}$ to $R^{33}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{31}$ and $Q^{32}$ independently represent an oxygen atom or a sulfur atom; $R^{31}$ and $R^{32}$, or $R^{32}$ and $R^{33}$ may bind with each other to thereby form a cyclic structure;

formula (IV)

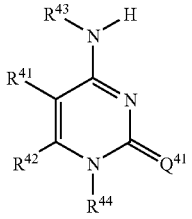

where, $R^{41}$ to $R^{44}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{41}$ and represents an oxygen atom or a sulfur atom; $R^{41}$ and $R^{42}$, $R^{41}$ and $R^{43}$, or $R^{42}$ and $R^{44}$ may bind with each other to thereby form a cyclic structure;

formula (V)

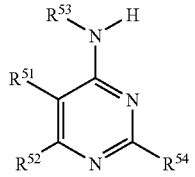

where, $R^{51}$ to $R^{54}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{51}$ and $R^{52}$, or $R^{51}$ and $R^{53}$ may bind with each other to thereby form a cyclic structure;

formula (VI)

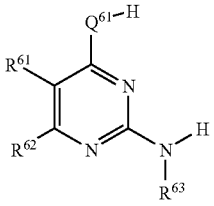

where, $R^{61}$ to $R^{63}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $Q^{61}$ represents an oxygen atom or sulfur atom; $R^{61}$ and $R^{62}$ may bind with each other to thereby form a cyclic structure;

formula (VII)

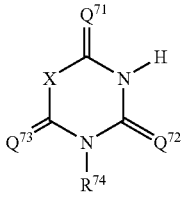

where, $Q^{71}$ to $Q^{73}$ independently represents an oxygen atom or a sulfur atom; X represents —C(=$R^{71}$)— or —C($R^{72}$)($R^{73}$)—; $R^{71}$ represents a substituent; $R^{72}$ to $R^{74}$ independently represents a hydrogen atom or a substituent; at least one of $R^{71}$ to $R^{74}$ represents a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{72}$ and $R^{73}$ may bind with each other to thereby form a cyclic structure;

formula (VIII)

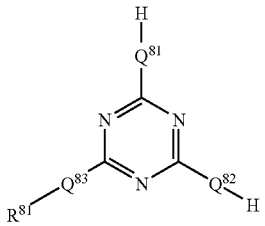

where, $Q^{81}$ to $Q^{83}$ independently represents an oxygen atom, a sulfur atom or N($R^{82}$); $R^{81}$ and $R^{82}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{81}$ and $R^{82}$ may bind with each other to thereby form a cyclic structure when $Q^{83}$ represents N($R^{82}$);

formula (IX)

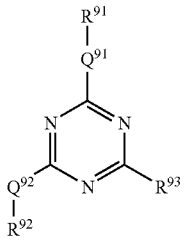

where, $Q^{91}$ and $Q^{92}$ independently represents a single bond, N($R^{94}$) where $R^{94}$represents a hydrogen or $C_{1-30}$ alkyl group, oxygen atom, sulfur atom, carbonyl, sulfonyl, or any combination thereof; $R^{91}$ and $R^{92}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{93}$ represents a halogen atom, hydroxyl, amino, mercapto, cyano, sulfide, carboxyl or a salt thereof, sulfo or a salt thereof, hydroxyamino, ureido, or urethane;

formula (X)

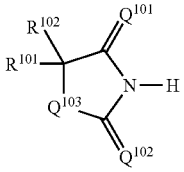

where, $Q^{101}$ to $Q^{103}$ independently represents an oxygen atom, sulfur atom or N($R^{103}$); $R^{101}$ to $R^{103}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; and formula (XI)

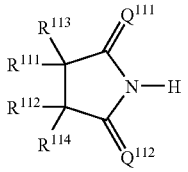

where, $Q^{111}$ and $Q^{112}$ independently represents an oxygen atom, sulfur atom or $N(R^{115})$; $R^{111}$ to $R^{115}$ independently represents a hydrogen atom or a substituent, at least one of which being a substituent containing at least one ester bond and at least one chain selected from the group consisting of $C_4$ or longer alkyl chains, oligoalkyleneoxy chains, $C_2$ or longer perfluoroalkyl chains, perfluoroalkyl ether chains and organic polysilyl chains; $R^{111}$ and $R^{113}$, $R^{113}$ and $R^{114}$, $R^{113}$ and $R^{115}$, $R^{112}$ and $R^{114}$, or $R^{114}$ and $R^{115}$ may bind with each other to thereby form a cyclic structure; and wherein said at least one of the molecules having at least one ester bond has a group represented by formula (c):

formula (c)

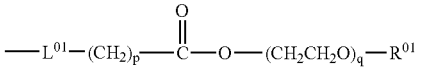

where, $L^{01}$ represents a bivalent linking group selected from the group consisting of an alkylene group, $NR^1$, where $R^1$ is a hydrogen atom or $C_{1-30}$ alkyl group, oxygen, sulfur, carbonyl, sulfonyl or any combinations thereof; $R^{01}$ represents a substituted or non-substituted $C_{1-30}$ alkyl group; p represents an integer from 1 to 20; and q represents and integer from 1 to 10, and formula (TAM)

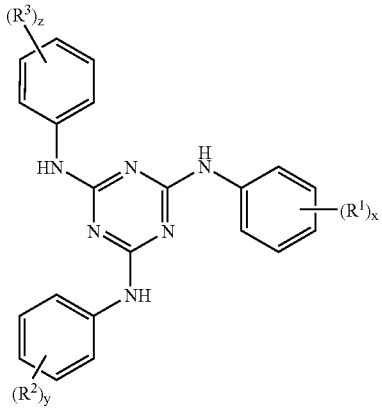

where $R^1$, $R^2$ and $R^3$ independently represents a substituent; x, y and z independently represent an integer of 1 to 5.

9. The method of claim 8, comprising said step of adding further one or more compounds represented by the following formula (XII) so as to form said molecular complex composed of both of the "n" kinds of compounds and the one or more compounds represented by the formula (XII), formula (XII)

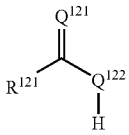

where, $R^{121}$ represents a substituent; $Q^{121}$ and $Q^{122}$ independently represents an oxygen atom or a sulfur atom.

* * * * *